US011465428B2

(12) United States Patent
Yonemitsu

(10) Patent No.: US 11,465,428 B2
(45) Date of Patent: Oct. 11, 2022

(54) CARD ATTITUDE CORRECTION DEVICE AND CARD PRINTING APPARATUS INCLUDING THE SAME

(71) Applicant: G-Printec, Inc., Kawasaki (JP)

(72) Inventor: Satoshi Yonemitsu, Kawasaki (JP)

(73) Assignee: G-PRINTEC, INC., Kawaski (JP)

( * ) Notice: Subject to any disclaimer, the term of this patent is extended or adjusted under 35 U.S.C. 154(b) by 358 days.

(21) Appl. No.: 16/821,547

(22) Filed: Mar. 17, 2020

(65) Prior Publication Data

US 2020/0307275 A1 Oct. 1, 2020

(30) Foreign Application Priority Data

Mar. 26, 2019 (JP) ..... JP2019-058829

(51) Int. Cl.
*B41J 13/02* (2006.01)
*B41J 13/10* (2006.01)
(Continued)

(52) U.S. Cl.
CPC ..... *B41J 13/02* (2013.01); *B41J 2/0057* (2013.01); *B41J 13/103* (2013.01); *B41J 13/12* (2013.01); *B65H 5/062* (2013.01); *B65H 9/101* (2013.01); *B65H 9/166* (2013.01); *B65H 5/36* (2013.01); *B65H 2404/1116* (2013.01);
(Continued)

(58) Field of Classification Search
CPC ..... B41J 13/02; B41J 2/0057; B41J 13/103; B41J 13/12; B65H 5/062; B65H 9/101; B65H 9/166; B65H 5/36; B65H 2404/1116; B65H 2404/1412; B65H 2404/741; B65H 2404/742; B65H 2701/1914
See application file for complete search history.

(56) References Cited

U.S. PATENT DOCUMENTS

2013/0249164 A1* 9/2013 Yokoyama ..... G03G 21/1642 271/225
2013/0264767 A1* 10/2013 Deno ..... B65H 9/00 271/226
2018/0362278 A1* 12/2018 Matsuda ..... B65H 7/14

FOREIGN PATENT DOCUMENTS

JP H02-010338 U 1/1990
JP 2000-3410 A 1/2000
(Continued)

OTHER PUBLICATIONS

Office Action dated Jun. 4, 2019 issued in corresponding Japanese Application No. 2019-058829.

*Primary Examiner* — Henok D Legesse
(74) *Attorney, Agent, or Firm* — Nath, Goldberg & Meyer; Jerald L. Meyer

(57) ABSTRACT

A second roller set is disposed separately from a first roller set in one direction of the conveyance direction, and includes an intermittent roller that generates, during one rotation, a conveyance enabled time of contacting the card and conveying the card and a conveyance disabled time of not contacting the card and not conveying the card. A third roller set is disposed separately from the second roller set. A reference guide wall receives abutments of a first end portion of the card and arranges a position of the card in the width direction at a reference position. An urging guide wall urges a second end portion of the card toward the reference guide wall by a first urging force. A support wall regulates a movement of the reference guide wall toward the urging guide wall at a position serving as the reference position.

2 Claims, 16 Drawing Sheets

(51) Int. Cl.

| | |
|---|---|
| ***B41J 2/005*** | (2006.01) |
| ***B41J 13/12*** | (2006.01) |
| ***B65H 9/16*** | (2006.01) |
| ***B65H 9/10*** | (2006.01) |
| ***B65H 5/06*** | (2006.01) |
| *B65H 5/36* | (2006.01) |

(52) U.S. Cl.
CPC ..... *B65H 2404/1412* (2013.01); *B65H 2404/741* (2013.01); *B65H 2404/742* (2013.01); *B65H 2701/1914* (2013.01)

(56) References Cited

FOREIGN PATENT DOCUMENTS

| | | | |
|---|---|---|---|
| JP | 2004-330782 | A | 11/2004 |
| WO | 2012/074001 | A1 | 6/2012 |

* cited by examiner

CARD ATTITUDE CORRECTION DEVICE AND CARD PRINTING APPARATUS INCLUDING THE SAME

CROSS REFERENCE TO RELATED APPLICATION

This application is based upon and claims the benefit of priority under 35U.S.C. § 119 from Japanese Patent Application No. 2019-058829 filed on Mar. 26, 2019, the entire contents of which are incorporated herein by reference.

BACKGROUND

The present disclosure relates to a card attitude correction device that corrects a conveying attitude and conveying position of a card and a card printing apparatus including the same.

Japanese Unexamined Patent Application Publication No. 2000-3410 (Patent Document 1) disclosed a card attitude correction device capable of correcting a conveying attitude of a card to be conveyed.

The card attitude correction device described in Patent Document 1 includes a first guide plate provided on one side edge of a card conveying path, a second guide plate provided on another side edge of the card conveying path and having a spring portion to press a card under conveyance against the first guide plate, and a card conveying roller that conveys the card. Then, a force with which the card conveying roller grips the card is set weak.

Thus, even when the card is being conveyed by the card conveying roller, an operation in which the second guide plate presses the card against the first guide plate is allowed by generating a slide between an upper surface of the card and the card conveying roller, and the attitude and conveying position of the card are corrected to an attitude and a position when the card abuts against the first guide plate.

Such a card attitude correction device as described above is provided in a card reader writer, a card printing apparatus including a printing mechanism, or the like. For example, in the card printing apparatus, a conveying device including the card attitude correction device corrects the attitude and conveying position of the card to a predetermined attitude and a predetermined position to insert the card into the printing mechanism so that printing is performed for the predetermined position of the card in the predetermined attitude.

The card that serves as a printing target in the card printing apparatus is an IC card or a credit card, for example.

The card printing apparatus prints a print image on at least one surface of both surfaces of the card by thermally transferring ink of an ink ribbon to the surface. Moreover, in a retransfer card printing apparatus, first, ink of an ink ribbon is transferred to a transfer film to form a transfer image thereon, and next, the transfer image formed on the transfer film is retransferred to the card to be printed thereon. Japanese Unexamined Patent Application Publication No. 2004-330782 (Patent Document 2) discloses a retransfer printing apparatus.

SUMMARY

A frictional force generated between the surface of the card and the conveying roller that conveys the card generally differs depending on a material, thickness, surface roughness, state of surface treatment or the like of the card, and does not necessarily become a fixed value.

Therefore, the card attitude correction device described in Patent Document 1 may not be able to satisfactorily perform such an attitude correction when not a specific card but a variety of cards are conveyed, and is desired to be improved. Moreover, the card printing apparatus including the card attitude correction device described in Patent Document 1 may not be able to satisfactorily perform printing since an attitude and position of the print image do not become the predetermined attitude and position, and is desired to be improved.

An object of one or more embodiments is to provide a card attitude correction device capable of satisfactorily correcting the attitude of the card regardless of a type of the card and a card printing apparatus capable of satisfactorily performing printing for the card.

A first aspect on one or more embodiments provides a card attitude correction device including: a first roller set configured to convey a card in a turnable manner while pinching a central region of the card in a width direction perpendicular to a conveyance direction; a second roller set disposed separately from the first roller set in one direction of the conveyance direction, and including an intermittent roller configured to generate, during one rotation, a conveyance enabled time of contacting the card and conveying the card and a conveyance disabled time of not contacting the card and not conveying the card; a third roller set disposed separately from the second roller set in the one direction, and configured to convey the card in an unturnable manner; a reference guide wall movable in a direction perpendicular to the conveyance direction, and configured to receive abutment of a first end portion of the card in the width direction and to arrange a position of the card in the width direction at a reference position; an urging guide wall configured to urge a second end portion of the card, the second end portion being opposite to the first end portion, toward the reference guide wall by a first urging force; and a support wall configured to regulate a movement of the reference guide wall toward the urging guide wall at a position serving as the reference position, wherein the reference guide wall is urged by a second urging force larger than the first urging force toward the urging guide wall and made movable in a direction perpendicular to the conveyance direction and separating from the urging guide wall by a force to resist the second urging force, wherein, during the conveyance disabled time when the card is located at a position at which it is possible to convey the card by the second roller set, the first roller set and the third roller set are incapable of conveying the card, and the urging guide wall corrects an attitude of the card and a position of the card in the width direction by urging the card by the first urging force to allow the card to abut against the reference guide wall positionally regulated by the support wall, and wherein, when the card is conveyed toward the reference guide wall at a position at which the first end portion shifts to an opposite side to the urging guide wall with respect to the reference position, the reference guide wall maintains the position serving as the reference position regulated by the support wall and conveys the card while turning the card in a case in which the card is conveyed by the first roller set, and the reference guide wall is retreated in a direction separating from the urging guide wall and conveys the card without turning the card in a case in which the card is conveyed by the third roller set.

A second aspect on one or more embodiments provides a card printing apparatus including: the above-described card attitude correction device; and a printing unit configured to print a card of which attitude is corrected by the card attitude correction device, wherein the printing unit positions an image in the width direction, the image to be printed on the card, based on a position in the width direction, at which the card abuts against the reference guide wall.

DETAILED DESCRIPTION

Figure 1:
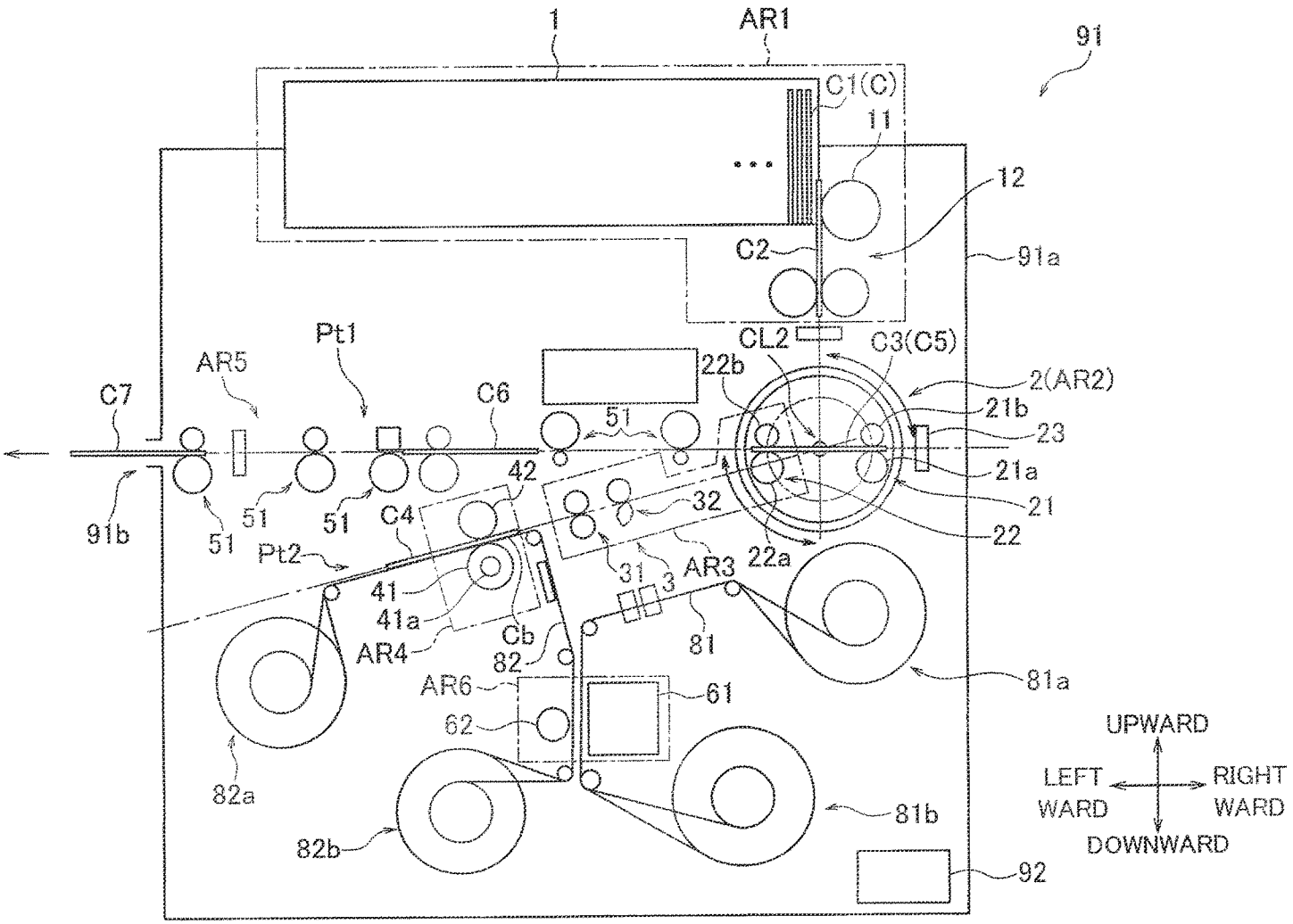
FIG. 1 is a schematic configuration diagram of printing apparatus 91 that is an example of a card printing apparatus according to one or more embodiments.

A card printing apparatus according to one or more embodiments is described by a printing apparatus 91 in an example illustrated in FIG. 1. The printing apparatus 91 an apparatus that thermally transfers ink of an ink ribbon 81 to a transfer film 82 to form a transfer image, and further, retransfers and prints the transfer image, which is formed on the transfer film 82, to a card C that is a printing target. The card C is an IC card, for example.

Figure 2:
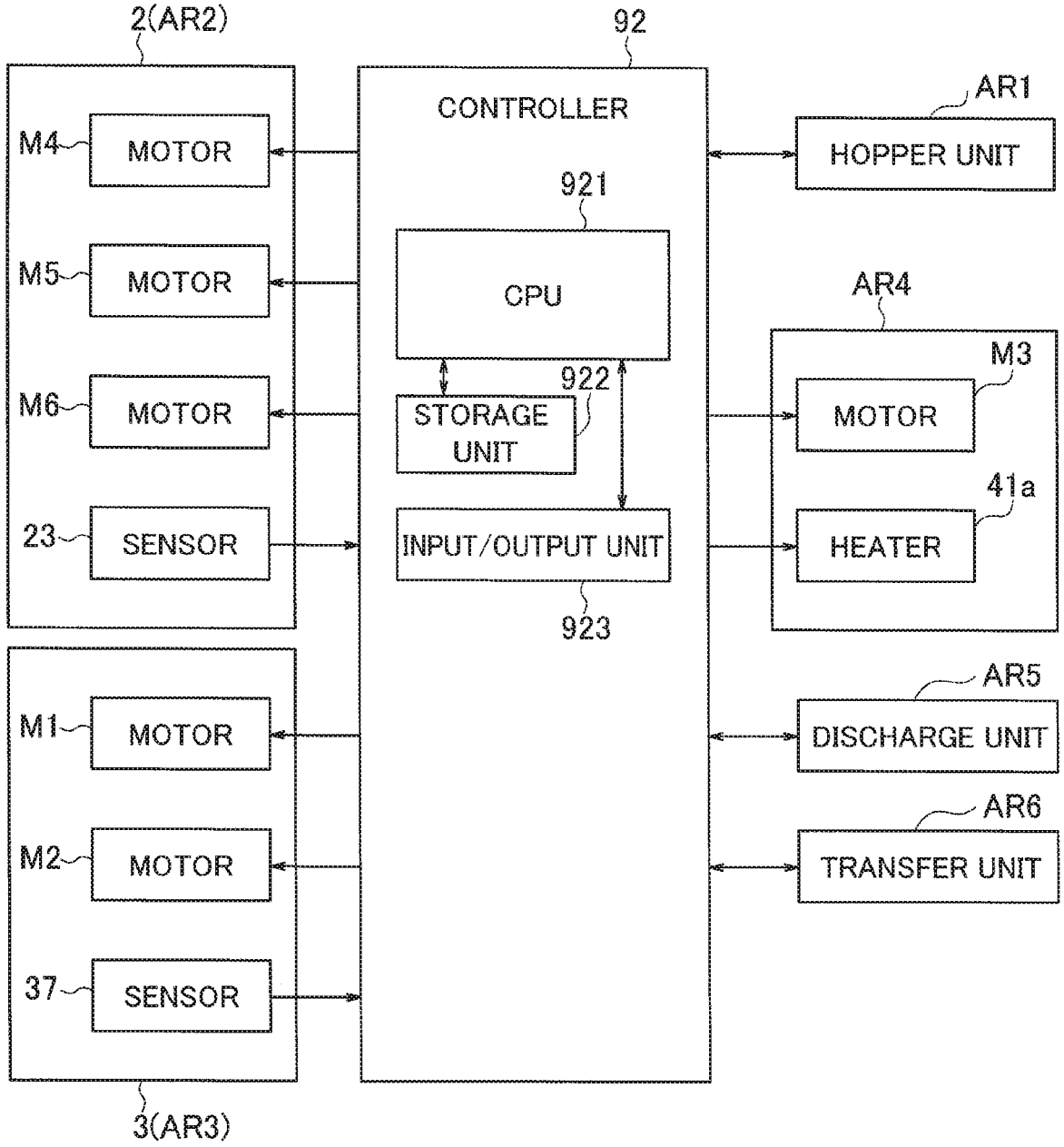
FIG. 2 is a block diagram illustrating an overall configuration of the printing apparatus 91.

Referring to FIG. 1 and FIG. 2, an entire schematic configuration of the printing apparatus 91 is described. FIG. 1 is an entire configuration diagram illustrating an entire configuration of the printing apparatus 91, and FIG. 2 is a block diagram illustrating a configuration of the printing apparatus 91. In FIG. 1, reference symbols of the card C are represented as C1, C2, . . . and C7 in response to positions on a conveying path, and are indicated while being appropriately added with parentheses in the following description. Moreover, for convenience of explanation, respective directions which are upward, downward, rightward, and leftward directions are defined by arrows in FIG. 1. Forward and backward directions are front and rear directions of a surface in FIG. 1, in which the front direction is the forward direction.

The printing apparatus 91 includes a main body case 91*a*, a hopper unit AR1, an inversion unit AR2, an attitude correction unit AR3, a retransfer unit AR4, a discharge unit AR5, a transfer unit AR6, and a controller 92.

The hopper unit AR1 is disposed in an upper portion of the main body case 91*a*, and includes: a card hopper 1 capable of housing a plurality of the cards C (C1); a pickup roller 11; and a cleaning roller set 12.

The pickup roller 11 transports one piece, which is located most rearward in the card hopper 1, downward. The card C (C2) transported downward by the pickup roller 11 has dust and the like on the front and back surfaces thereof removed by the cleaning roller set 12, and is sent out to the inversion unit AR2 located therebelow. In this example, the card C is housed in the card hopper 1 in an attitude in which the upward and downward direction of FIG. 1 is lateral and the front and back direction thereof is longitudinal, and is conveyed in such a lateral direction.

The printing apparatus 91 includes, as conveying paths of the card C, a discharge path Pt1 that is a first path extending from the inversion unit AR2 horizontally leftward in FIG. 1, and a retransfer path Pt2 that is a second path extending from the inversion unit AR2 slantingly left downward in FIG. 1.

The inversion unit AR2 includes an inverter 2 having a first inversion roller set 21 and a second inversion roller set 22. The first inversion roller set 21 and the second inversion roller set 22 are arranged separately from each other so as to pinch regions of the card C (C3) on one end side and another end side in the lateral direction.

The first inversion roller set 21 includes an inversion drive roller 21*a*, and an inversion driven roller 21*b* that presses the inversion drive roller 21*a*. The second inversion roller set 22 includes an inversion drive roller 22*a*, and an inversion driven roller 22*b* that presses the inversion drive roller 22*a*.

Figure 4:
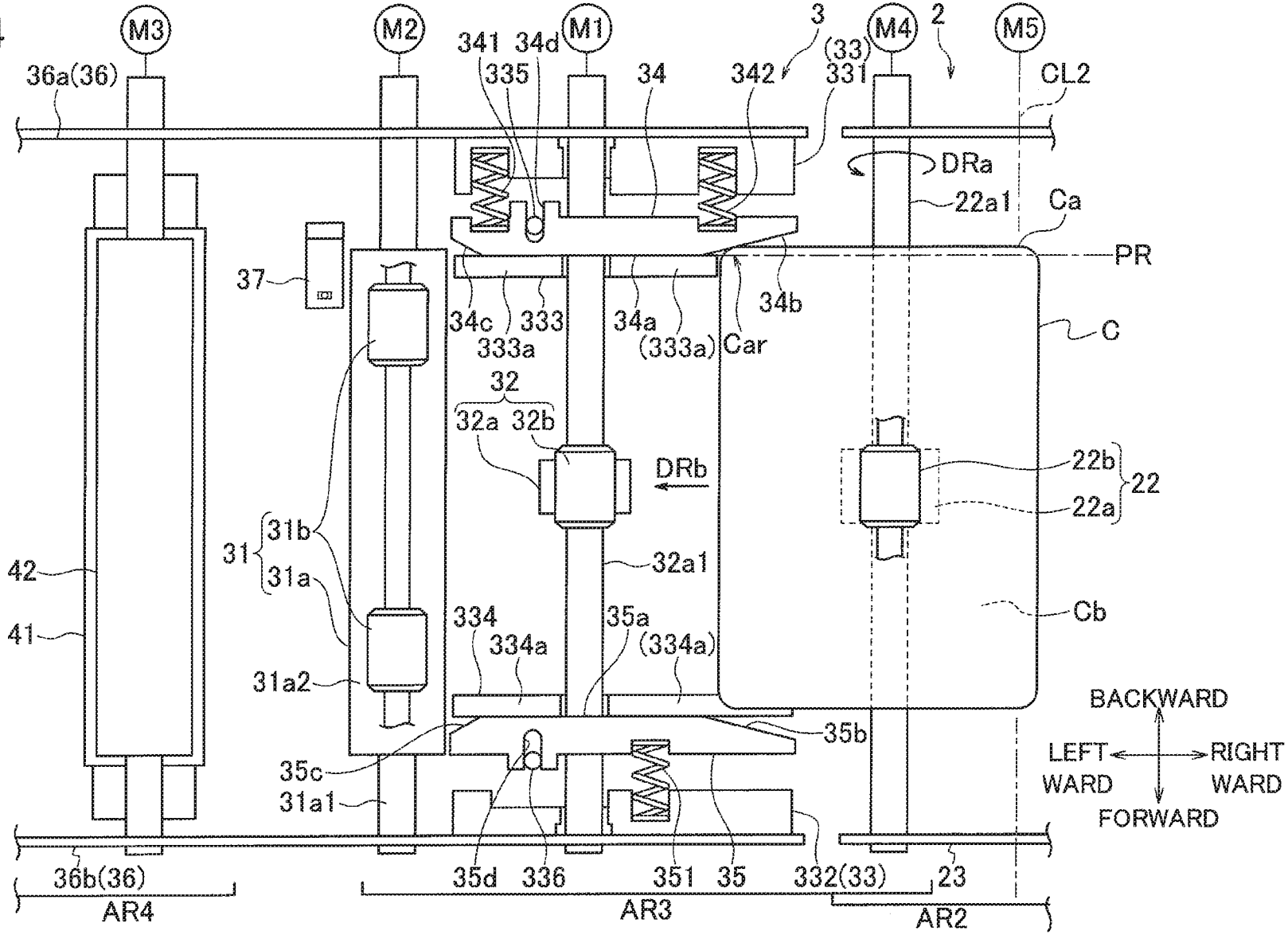
FIG. 4 is a plan view illustrating a first conveying state of a card C.

In the first inversion roller set 21 and the second inversion roller set 22, the inversion drive roller 21*a* and the inversion drive roller 22*a* are driven by a motor M6 and a motor M4 (see FIG. 2), respectively, and the inverter 2 rotates around an axial line C12 (see FIG. 1 and FIG. 4) by a motor M5 (see FIG. 2 and FIG. 4). Rotation operations and rotation directions of the motors M4 to M6 are controlled by the controller 92.

Thus, in the inversion unit AR2, the inverter 2 can receive the card C (C2) sent out from the hopper unit AR1, and can invert the front and back of the card C by rotating after receiving the card C (C2). Moreover, the inversion unit AR2 can send out the received card C (C3) to either the discharge path Pt1 or the retransfer path Pt2.

In response to a rotation position of the inverter 2, one of the first inversion roller set 21 and the second inversion roller set 22, which is closer to the attitude correction unit AR3, is shared by the attitude correction unit AR3. In FIG. 1, the second inversion roller set 22 is included in the attitude correction unit AR3.

As illustrated in FIG. 4, the second inversion roller set 22 conveys the card C, which is to be conveyed, while pinching a substantially central region thereof in the forward and backward directions. The same also applies to the first inversion roller set 21 that is not illustrated in FIG. 4.

The inverter 2 receives and holds the card C (C2), which is sent out from the hopper unit AR1 and is unprinted or has only one surface printed, and in addition, rotates and turns the card C (C2) so that a printing surface Cb thereof that will be printed from now on faces downward in FIG. 1. Subsequently, the inverter 2 sends out the held card C (C3) to the retransfer path Pt2.

The retransfer path Pt2 includes the attitude correction unit AR3 and the retransfer unit AR4 in order from the inversion unit AR2 side. For the card C, the attitude correction unit AR3 executes an attitude correction operation that serves as a positioning operation of a direction (width direction) perpendicular to the conveyance direction, and inserts the card C of which attitude is corrected into the retransfer unit AR4.

The retransfer unit AR4 that functions as a printing unit for performing printing for the card C includes: a retransfer heat roller 41 that incorporates a heater 41*a* therein; and a back roller 42 that moves following the retransfer heat roller 41 while pressing the same. The retransfer heat roller 41 rotates by an operation of a motor M3. The operations of the motor M3 and the heater 41*a* are controlled by the controller 92.

As illustrated in FIG. 1, the retransfer unit AR4 pinches and conveys the transfer film 82 and the card C (C4) between the retransfer heat roller 41 and the back roller 42 while bringing the transfer film 82 and the card C (C4) into intimate contact with each other. Then, the retransfer unit AR4 prints the transfer image, which is formed on the transfer film 82, on the printing surface Cb of the card C (C4) under conveyance by transferring the transfer image to the printing surface Cb of the card C (C4) by heat of heater 41*a*. The transfer image of the transfer film 82 is formed in advance in the transfer unit AR6.

The transfer unit AR6 is disposed below the attitude correction unit AR3. The transfer unit AR6 includes a thermal head 61 and a platen roller 62 that leaves and contacts the thermal head 61 so as to be capable of being pressure-attached thereto.

During a period while sandwiching and conveying the ink ribbon 81 and the transfer film 82 between the thermal head 61 and the platen roller 62 while bringing the ink ribbon 81 and the transfer film 82 into intimate contact with each other, the transfer unit AR6 thermally transfers an image, which is to be printed on the card C (C4) in the retransfer unit AR4, from the ink ribbon 81 to the transfer film 82 by an operation of the thermal head 61.

The ink ribbon 81 is passed between the thermal head 61 and the platen roller 62 and wound between a first bobbin 81*a* and a second bobbin 81*b*.

The transfer film 82 is passed between the thermal head 61 and the platen roller 62 and wound between a film first bobbin 82*a* and a film second bobbin 82*b*. The transfer film 82 is also passed between the retransfer heat roller 41 and back roller 42 of the retransfer unit AR4.

In the retransfer unit AR4, the card C (C4) in which the transfer image is printed on the printing surface Cb by the transfer, is reversed through the retransfer path Pt2 and returned to the inverter 2.

When the printing for the card C is single-sided printing, the card C (C5) returned to the inverter 2 is inserted into the discharge path Pt1 by the inverter 2. The card C (C6) inserted into the discharge path Pt1 is conveyed leftward in FIG. 1 by a plurality of discharge roller sets 51 provided in the discharge path Pt1, and is discharged as the card C (C7), which has one surface already printed, from a discharge port 91*b* to an outside of the main body case 91*a*.

When the printing for the card C is doubled-sided printing, the card C (C5) returned to the inverter 2 is inverted by the inverter 2, and is inserted into the retransfer path Pt2 again. Then, in the retransfer unit AR4, the card C (C5) is printed by transfer on a second surface opposite to such a first surface thus already printed, and thereafter, is returned to the inverter 2 again.

Thereafter, the card C (C5) returned to the inverter again is inserted into the discharge path Pt1 by the inverter 2, and is discharged as the card C (C7) having both surfaces already printed from the discharge port 91*b*.

Operations of the respective rollers and the respective bobbins for conveying the card C and operations of the retransfer heat roller 41, the thermal head 61 and the platen roller 62 for the transfer are controlled by the controller 92.

In the respective rollers, outer peripheral portions thereof which contact the card C are formed of a material such as rubber from which a high friction coefficient is obtained.

As illustrated in FIG. 2, the controller 92 includes a central processing unit (CPU) 921, a storage unit 922, and an input/output unit 923, and controls operations of the card printing apparatus 91 including the card attitude correction device 3. Hereinafter, the card attitude correction device 3 will be simply referred to as an attitude correction device 3.

With the above-mentioned configuration, the printing apparatus 91 can print the card C on one surface or both surfaces thereof by transfer.

Figure 3:
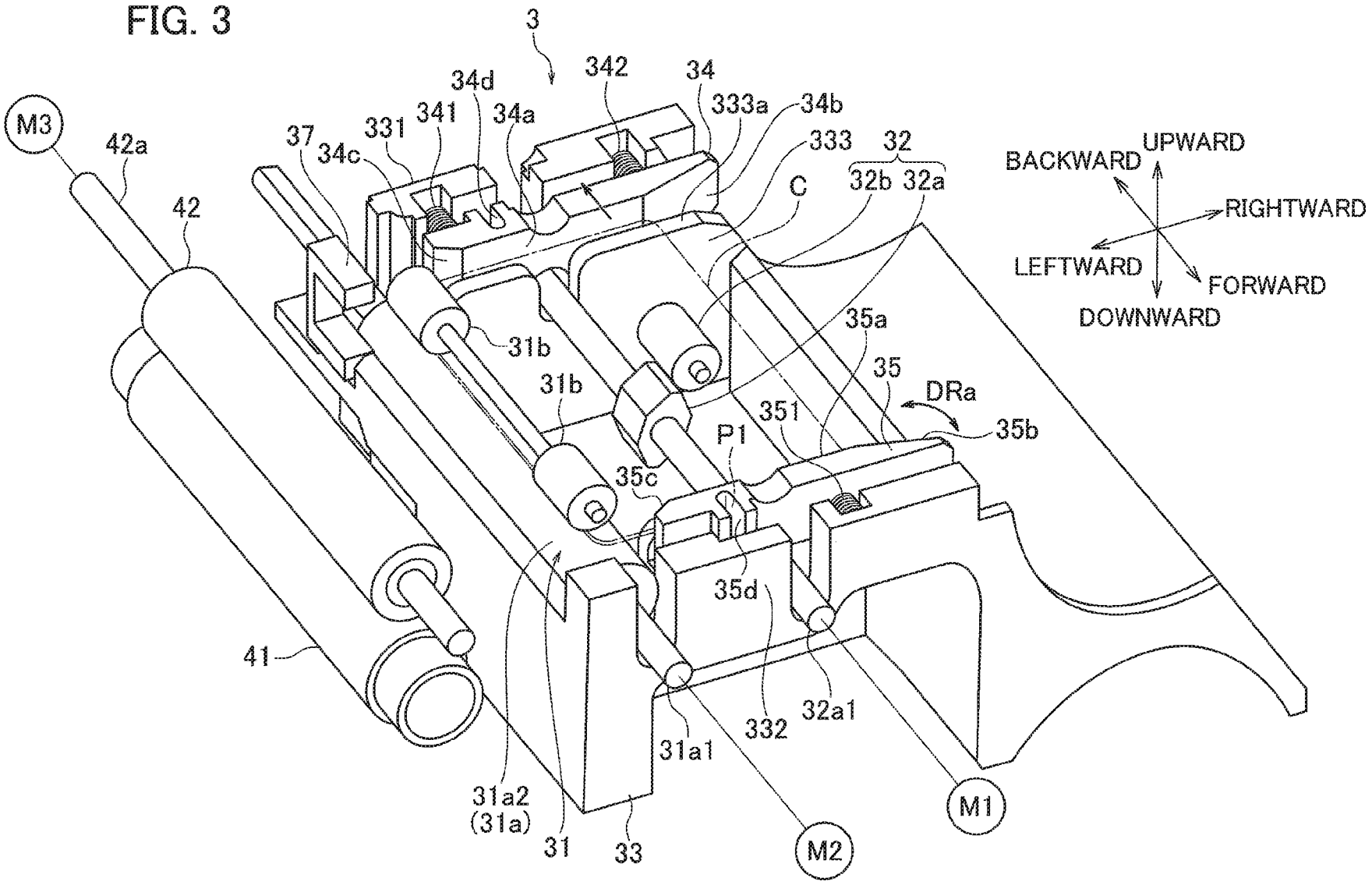
FIG. 3 is a perspective view of a main portion of an attitude correction device 3 that is an example of a card attitude correction device according to one or more embodiments.

Next, mainly referring to FIG. 3 to FIG. 7, a configuration of the attitude correction unit AR3 is described in detail. FIG. 3 is a perspective view of a main portion of the attitude correction device 3 provided in the attitude correction unit AR3, and FIG. 4 is a plan view of the attitude correction device 3.

In FIG. 3, the retransfer heat roller 41 and the back roller 42 in the retransfer unit AR4 are also illustrated in combination. In FIG. 4, in addition to the retransfer heat roller 41 and the back roller 42 in the retransfer unit AR4, the second inversion roller set 22 in the inverter 2, which is included in the attitude correction unit AR3, is also illustrated in combination.

Figure 5:
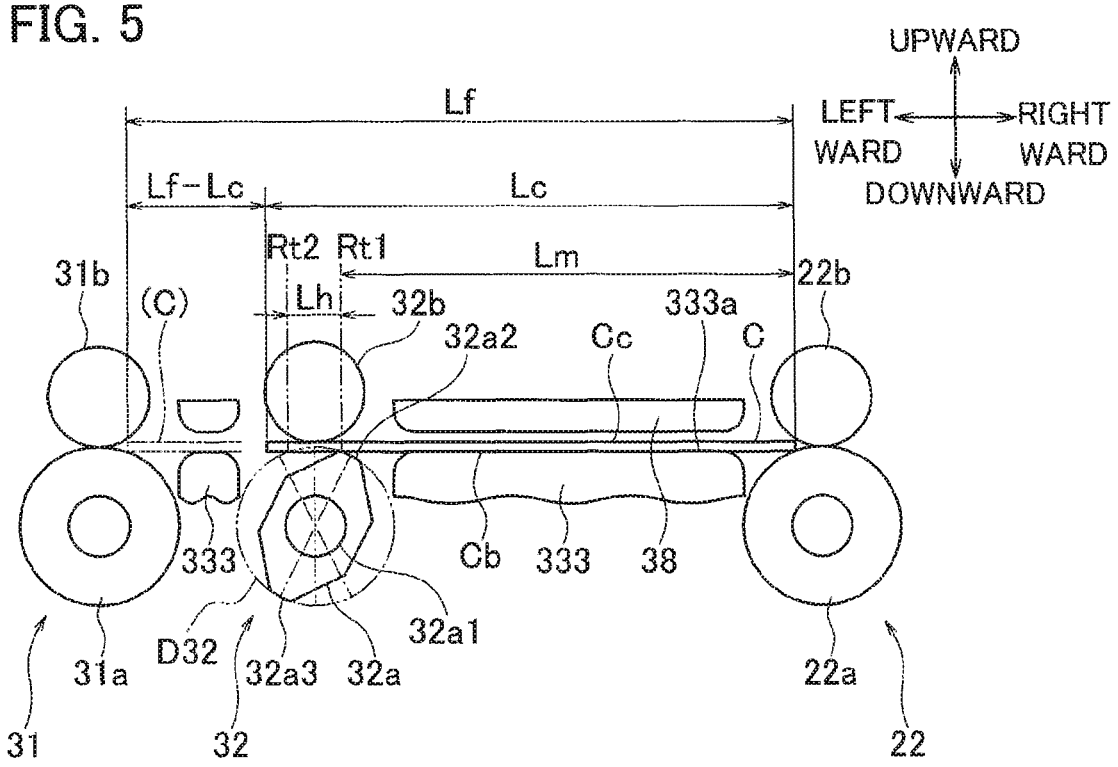
FIG. 5 is a schematic side view when an intermittent roller 32*a* provided in the attitude correction device 3 is located at a first rotational position.
Figure 6:
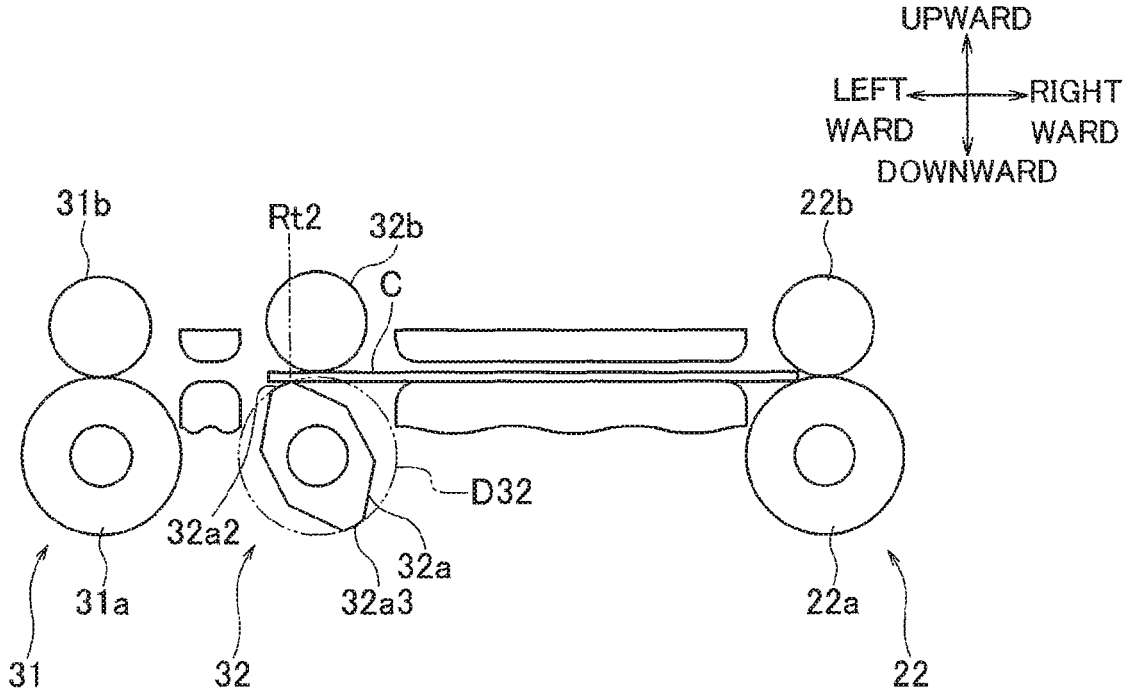
FIG. 6 is a schematic side view when the intermittent roller 32*a* is located at a second rotational position.
Figure 7:
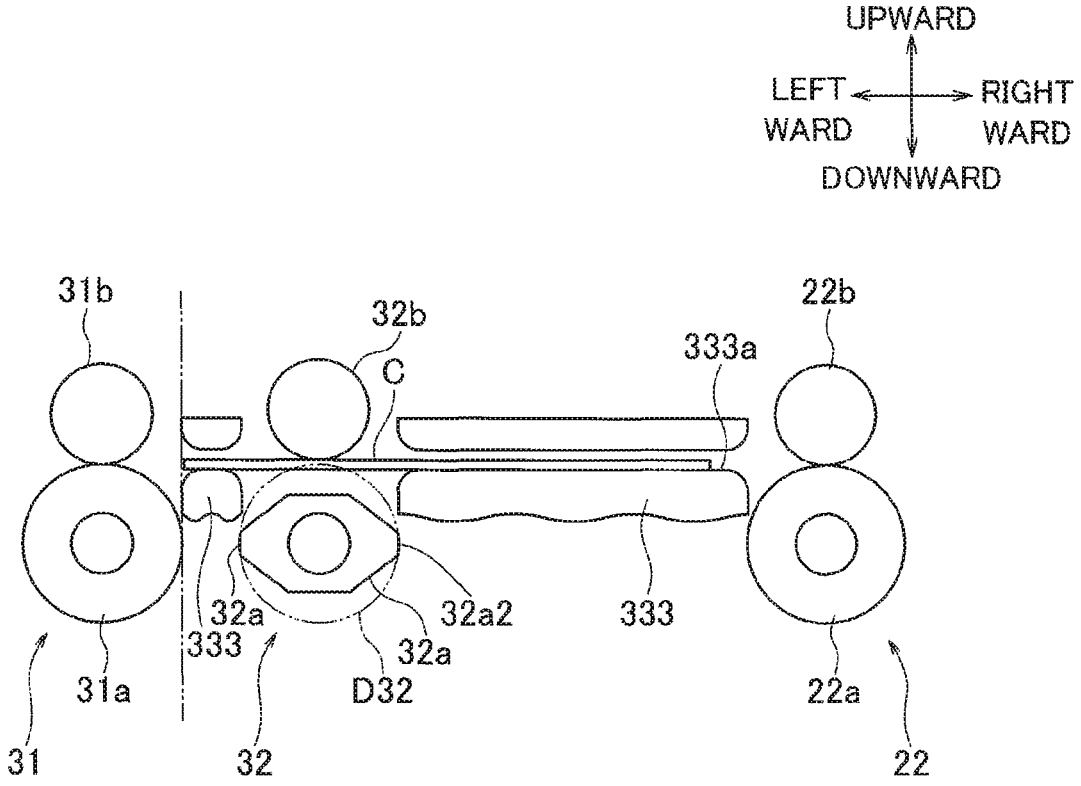
FIG. 7 is a schematic side view when the intermittent roller 32*a* is located at a third rotational position.

FIG. 5 to FIG. 7 are schematic side views illustrating the first to third rotational positions of an intermittent roller 32*a* provided in the attitude correction device 3, respectively.

For convenience of explanation, respective directions which are upward, downward, rightward, leftward, forward, and backward directions are defined by directions indicated by arrows in FIG. 3. Here, for the sake of convenience, the rightward and leftward directions are defined as extending directions or the retransfer path Pt2, and the upward and downward directions are defined as directions perpendicular to the same.

As illustrated in FIG. 4, the attitude correction device 3 is supported by a pair of frames 36 erected so as to face each other separately from each other forward and backward in the main body case 91*a*. The backward frame 36 is defined as a back frame 36*a*, and the forward frame 36 is defined as a front frame 36*b*. In FIG. 3, the frames 36 are not illustrated.

As illustrated in FIG. 4, in order from the closer side to the retransfer unit AR4, the attitude correction device 3 of the attitude correction unit AR3 includes a holding roller set 31 and an intermittent roller set 32, which are freely rotatably supported on the frames 36*a* and 36*b*. Moreover, the attitude correction device 3 includes the second inversion roller set 22 in the inversion unit AR2, and the second inversion roller set 22 is illustrated in the right side of FIG. 4. That is, the attitude correction unit AR3 includes one of the first and second inversion roller sets (the one is also referred to as a first roller set), the intermittent roller set 32 (also referred to as a second roller set), and the holding roller set 31 (also referred to as a third roller set).

The holding roller set 31, the intermittent roller set 32, and the second inversion roller set 22 include shafts 31*a*1, 32*a*1, and 22*a*1 in which axial lines extend in the forward and backward directions perpendicular to the conveyance direction which are the rightward and leftward directions. The shafts 31*a*1, 32*a*1, and 22*a*1 are rotationally driven by a motor M2, a motor M1, and a motor M4, respectively.

The holding roller set 31 includes a holding roller 31*a* having the shaft 31*a*1, and a pair of driven rollers 31*b*. The holding roller 31*a* has a roller portion 31*a*2 that is longer than a length of the card C in a longitudinal direction as such a forward/backward direction thereof and is disposed so as to include all of a longitudinal range of the card C.

The pair of driven rollers 31*b* and 31*b* are disposed above the holding roller 31*a* separately from each other in an axial direction thereof, and press the holding roller 31*a* to rotate so as to be driven thereby. With the holding roller 31*a*, the pair of driven rollers 31*b* and 31*b* pinch vicinities of both edge portions of the card C in a width direction that is a longitudinal direction of the card C and perpendicular to the conveyance direction.

The card C that is being conveyed by the holding roller set 31 is conveyed in such a manner that a plurality of spots thereof separate from each other in the width direction are pinched by the holding roller 31*a* formed of a highly frictional material and the driven rollers 31*b* and 31*b* formed of the highly frictional material. Thus, the card C becomes unturnable while being conveyed, and is sent out downstream from the holding roller set 31 while maintaining the attitude at the time of being inserted into the holding roller set 31.

The intermittent roller set 32 includes the intermittent roller 32*a* and a driven roller 32*b* disposed above the intermittent roller 32*a*. As illustrated in FIG. 5, the intermittent roller 32*a* is not circular when viewed in the axial direction, and has protrusions 32*a*2 and 32*a*3 having outer shapes, which become circular arcs of a common circle D32, at positions separate from each other by a predetermined angle about an axial line. In this example, the predetermined angle is 180°. Portions other than the protrusions 32*a*2 and 32*a*3 are formed into outer shapes smaller than the common circle D32.

A distance in the conveyance direction between the holding roller set 31 and the intermittent roller set 32 is set so sufficiently shorter than the length of the card C in the conveyance direction that the card C can be conveyed without fail by either of the roller sets.

As illustrated FIG. 5, the driven roller 32*b* is always in contact with an upper surface Cc of the card C that has entered between the intermittent roller 32*a* and the driven roller 32*b*. Meanwhile, in the printing surface Cb that is a lower surface, following the rotation of the intermittent roller 32*a*, there alternately occurs: a contact state in which either the protrusion 32*a*2 or the protrusion 32*a*3 is in contact with the printing surface Cb and presses the printing surface Cb against the driven roller 32*b*; and a non-contact state in which neither the protrusion 32*a*2 nor the protrusion 32*a*3 is in contact therewith.

As illustrated in FIG. 4, a base 33 is provided between the back frame 36*a* and the front frame 36*b*. The base 33 has a first wall portion 331 fixed to the back frame 36*a*, a second wall portion 332 fixed to the front frame 36*b*.

As illustrated in FIG. 3 and FIG. 4, on a front side of the first wall portion 331, a reference guide wall 34 is disposed in parallel thereto. The reference guide wall 34 is a first guide wall that extends in the rightward and leftward directions which is the conveyance direction of the card C. The reference guide wall 34 is made unmovable in the rightward and leftward directions and movable in the forward and backward directions in such a manner that a pin 335 provided on the first wall portion 331 engages with a notch 34*d* formed on a left portion of the reference guide wall 34.

Between the reference guide wall 34 and the first wall portion 331, coil springs 341 and 342 as urging members are interposed separately from each other in the conveyance direction while being compressed. By elastic repulsive forces of the compressed coil springs 341 and 342, which are directed forward, the reference guide wall 34 is thrust against a first support wall 333 erected on the base 33. Thus, a position of the reference guide wall 34 in the forward and backward directions is determined.

As illustrated in FIG. 4, a position of a reference surface 34*a* in a state in which the reference guide wall 34 is thrust against the first support wall 333 is defined as a reference front/back position PR.

The reference guide wall 34 has: a reference surface 34*a* that is thrust against the first support wall 333 in a natural state, abuts against the first support wall 333, and extends in the upward, downward, rightward, and leftward directions; and a forward feeding guide surface 34*b* and a reverse feeding guide surface 34*c*, which are formed on a right side and left side of the reference surface 34*a*, respectively, and are individually inclined backward as going toward end portions thereof.

The reference guide wall 34 is movable backward by a force to resist an elastic repulsive resultant force of the coil springs 341 and 342. Moreover, since the coil springs 341 and 342 are disposed separately from each other crosswise, the reference guide wall 34 is also capable of swinging by differentiating respective compression amounts of the coil springs 341 and 342.

Behind the second wall portion 332, an urging guide wall 35 is disposed in parallel thereto. The urging guide wall 35 is a second guide wall extending in the rightward and leftward directions as the conveyance direction of the card C. The urging guide wall 35 is made unmovable in the rightward and leftward directions and movable in the forward and backward directions in such a manner that a pin 336 provided on the second wall portion 332 engages with a notch 35*d* formed on a left portion of the urging guide wall 35.

In a right portion of the urging guide wall 35, a coil spring 351 as an urging member is interposed between the right portion and the second wall portion 332 while being compressed. The urging guide wall 35 is rotatable like an arrow DRa, which is illustrated in FIG. 3, about a position P1 of the in 336, which is taken as a substantial center of the rotation. Moreover, the urging guide wall 35 is urged counterclockwise in FIG. 4 by an elastic repulsive force directed backward of the coil spring 351. Thus, the urging guide wall 35 is thrust against a second support wall 334 erected on the base 33, and a position thereof in the forward and backward directions is determined.

The urging guide wall 35 has: a reference surface 35*a* that is thrust against the second support wall 334 in a natural state, abuts against the second support wall 334, and extends in the upward, downward, rightward, and leftward directions; and a forward feeding guide surface 35*b* and a reverse feeding guide surface 35*c*, which are formed on a right side and left side of the reference surface 35*a*, respectively, and are individually inclined backward as going toward end portions thereof.

Upper surfaces of the first support wall 333 and the second support wall 334 are formed as a first sliding surface 333*a* and a second sliding surface 334*a*, respectively. The first sliding surface 333*a* and a second sliding surface 334*a* serve as surfaces which support the card C and have the card C slide thereon at the time of conveying the card C.

A distance in the forward/backward direction between the reference surface 34*a* of the reference guide wall 34, which abuts against the first support wall 333, and the reference surface 35*a* of the urging guide wall 35, which abuts against the second support wall 334, is slightly shorter than the length of the card C in the longitudinal direction as the forward/backward direction thereof.

An urging force as a resultant force obtained by adding an urging force of the coil spring 341 and an urging force of the coil spring 342 to each other, which urge the reference guide wall 34 forward, is set sufficiently larger than an urging force of the coil spring 351, which urges the urging guide wall 35 backward. In other words, with regard to forces required to move the reference guide wall 34 and the urging guide wall 35 forward and backward by the same distance, respectively, the force for the urging guide wall 35 is smaller.

In FIG. 4, in a transfer operation to the card C in the retransfer unit AR4, a transfer position of the printing surface Cb of the card C in the conveyance direction (rightward and leftward directions) is controlled by the controller 92 based on a rotation angle of the holding roller set 31 from a point of time when the position of the card C in the conveyance direction is detected by a sensor 37.

Meanwhile, a transfer position in the direction perpendicular to the conveyance direction is set while taking as a reference a state in which a back edge portion Ca that is a first end portion of the card C in the width direction is located at the reference front/back position PR. In other words, the attitude of the card C and the position thereof in the forward and backward directions are corrected so that the back edge portion Ca of the card C abuts in a surface contact manner against the reference surface 34*a* of the reference guide wall 34, which abuts against the first support wall 333. Then, the card C is inserted into the retransfer unit AR4 while keeping on maintaining the corrected attitude and position in the forward and backward directions, whereby the transfer position in the direction perpendicular to the conveyance direction can be determined with high accuracy.

In some cases, the card C in which the attitude is corrected and the position in the forward and backward directions is positioned to a normal position will be hereinafter referred to as a card C of which attitude is already corrected, will have the reference symbol appropriately added with (Ck), and will be distinguished from such a card of which attitude is uncorrected.

As illustrated in FIG. 5, in the attitude correction device 3, mutual distances in the conveyance direction of the card C between the holding roller set 31, the intermittent roller set 32, and the second inversion roller set 22 of the inverter 2 are set so as to have predetermined relationships, which are defined by the following Inequality (1) and Inequality (2), by using a distance Lf, a length Lc, a distance Lh, and a distance Lm.

$$\text{distance } Lh < \text{distance } Lf - \text{length } Lc \quad (1)$$

$$\text{distance } Lm < \text{length } Lc \quad (2)$$

The distance Lf is a distance in the conveyance direction between a position at which it is possible to pinch the card C in the second inversion roller set 22, the position being closest to the intermittent roller set 32, and a position at which it is possible to pinch the card C in the holding roller set 31, the position being closest to the intermittent roller set 32. The distance Lf is also referred to as a no card holding distance.

The length Lc is a length of the card C n the conveyance direction. In this example, the distance Lc is a width of the card C in the lateral direction, and is also referred to as a card lateral length.

The distance Lh is a maximum distance in which the card C is movable in the conveyance direction by contact with one protrusion (for example, the protrusion 32*a*2) of the intermittent roller 32*a*. That is, the distance Lh is a distance in the conveyance direction between a position Rt1 and a position Rt2, which are illustrated in FIG. 5, and is also referred to as an intermittent roller conveying distance.

The distance Lm is a conveyance direction distance between the position Rt1 and a position at which it is possible to pinch the card C in the second inversion roller set 22, the position being closest to the intermittent roller set 32. The distance Lm is also referred to as a conveyance enabling distance.

The distance Lm is a distance to be set for making it possible to convey the card C by one of the second inversion roller set 22 and the intermittent roller set 32 and to thereafter convey the card C continuously. By this setting, the card C supplied from one side of the attitude correction unit AR3 is conveyed to another side without fail.

As illustrated in FIG. 5 and FIG. 6, the position Rt1 and the position Rt2 are described as follows. That is, the position Rt1 is a position closest to the second inversion roller set 22 between a position at which one of the protrusions 32*a*2 and 32*a*3 (here, the protrusion 32*a*2) starts to contact the printing surface Cb that is the lower surface of the card C and a position at which the protrusion 32*a*2 separates from the printing surface Cb when the intermittent roller 32*a* rotates. The position Rt2 is a position closest to the holding roller set 31 between the above-described position at which the protrusion 32*a*2 starts to contact the printing surface Cb and the position at which the protrusion 32*a*2 separates therefrom.

By Inequality (1), with regard to the card C in which the whole of the length in the conveyance direction is located between the second inversion roller set 22 and the holding roller set 31, there is ensured a time while the card C is not conveyed by the intermittent roller set 32 during a period while the intermittent roller 32*a* of the intermittent roller set 32 rotates once.

With regard to the card C in which the whole of the length in the conveyance direction is located between the second inversion roller set 22 and the holding roller set 31, such a state and a time in which the card C is not conveyed by the intermittent roller set 32 as described above are referred to as conveyance disabled state and a conveyance disabled time, respectively, and a state and a time in which the card C is conveyed thereby are referred to as a conveyance enabled state and a conveyance enabled time, respectively.

By Inequality (2), it becomes possible to convey the card C, which is supplied from one side to the attitude correction unit AR3, to another side without fail by the second inversion roller set 22 and the intermittent roller set 32.

By the attitude correction device 3 configured as described above, the card C sent out from the inverter 2 has the attitude corrected by the attitude correction operation described with reference to FIG. 4 and FIG. 8 to FIG. 13 which follow, and is inserted into the retransfer unit AR4.

The attitude correction operation is an operation of positioning the position of the card C, which is sent out from the inverter 2 to the attitude correction device 3, in the forward and backward directions perpendicular to the conveyance direction by bringing the back edge portion Ca of the card C into surface contact with the reference surface 34*a* located at the reference front/back position PR.

In FIG. 8 to FIG. 13, for simplifying the drawing, the shafts of the holding roller set 31, the intermittent roller set 32, and the second inversion roller set 22 are partially or entirely omitted as appropriate.

First, a description is given of a case of a first operation mode in which the card C is sent out from the inverter 2 to the attitude correction device 3 in an attitude in which the back edge portion Ca shifts to the back side with respect to the reference front/back position PR as illustrated in FIG. 4.

In the inverter 2, the card C is sent out toward the left attitude correction unite AR3 by the second inversion roller set 22 driven by the motor M4 (see an arrow DRb). Since the card C shifts to the back side, a left back corner portion Car of the back edge portion Ca abuts against the forward feeding guide surface 34*b* of the reference guide wall 34.

Figure 8:
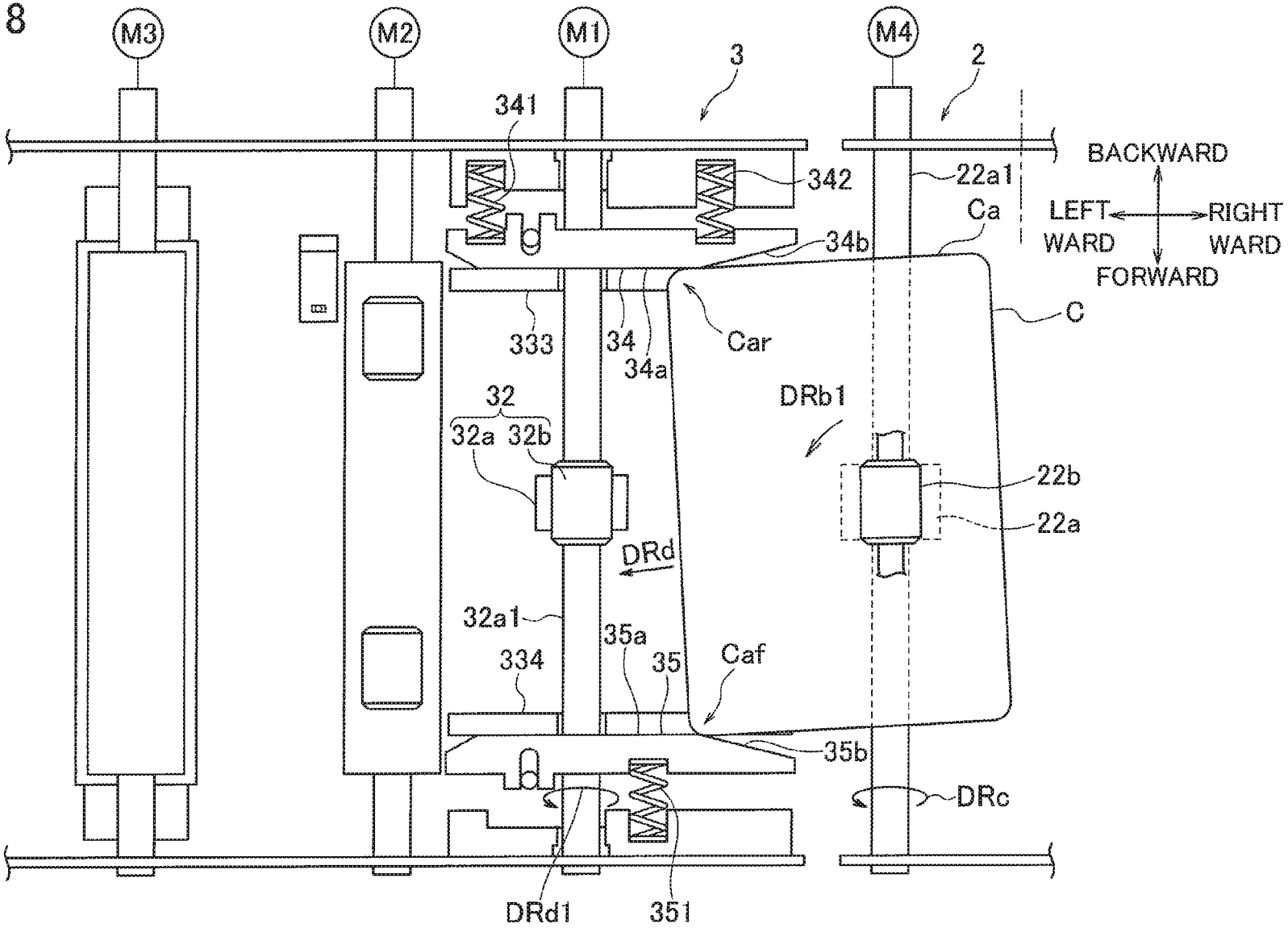
FIG. 8 is a plan view illustrating a second conveying state of the card C.

By an operation of the motor M1, the intermittent roller set 32 of the attitude correction device 3 has started to rotate in a direction of sending the card C leftward (see DRd1 of FIG. 8).

When the card C is further conveyed leftward by the second inversion roller set 22, the card C cannot resist the urging force to urge the reference guide wall 34 forward since the urging force as the resultant force of the coil springs 341 and 342 is set relatively large, and the card C is conveyed while allowing the left back corner portion Car to slide on the forward feeding guide surface 34*b* of the reference guide wall 34.

Here, as illustrated in FIG. 8, the second inversion roller set 22 pinches only such a central portion of the card C in the forward and backward directions, and accordingly, the card C is turnable while being conveyed. That is, the card C can turn counterclockwise as illustrated by an arrow DRb1 and can tilt the attitude thereof. Therefore, the card C is conveyed leftward while being tilted counterclockwise (see an arrow DRd), and a left front corner portion Caf of the card C abuts against the urging guide wall 35.

Figure 9:
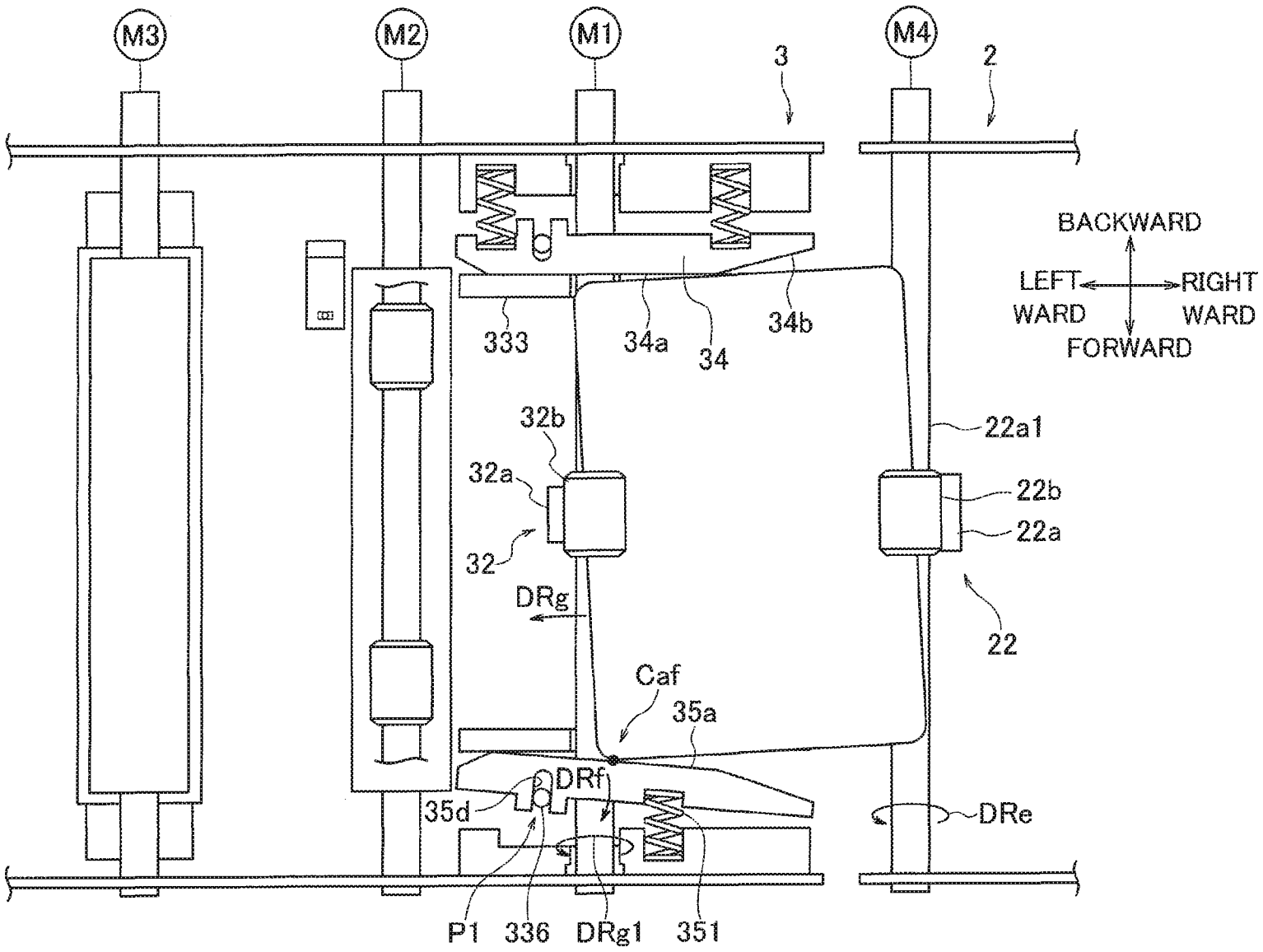
FIG. 9 is a plan view illustrating a third conveying state of the card C.

When the card C continues to be conveyed, then, as illustrated in FIG. 9, the urging guide wall 35 is pushed forward by the left front corner portion Caf of the card C and rotates clockwise (see an arrow DRf) since the urging guide wall 35 is movable against the urging force by a smaller force than to the reference guide wall 34. That is, the urging guide wall 35 rotates and allows further leftward conveyance of the card C, which is indicated by an arrow DRg.

The rotation of the intermittent roller set 32, which is indicated by an arrow DRg1, continues. The position of the reference surface 34*a* of the reference guide wall 34 is maintained at the reference front/back position PR since the forward urging forces of the coal springs 341 and 342 are sufficiently large.

When the card C is conveyed further leftward, a driving source of the conveyance is taken over from the second inversion roller set 22 to the intermittent roller set 32 by the above-mentioned definition of Inequality (2).

At this time, when the intermittent roller 32*a* of the intermittent roller set 32 is in the conveyance disabled state, the attitude correction device 3 executes the attitude correction operation, and when the intermittent roller 32*a* is not in the conveyance disabled state, the attitude correction device 3 executes the attitude correction operation after the intermittent roller 32*a* rotates a little and the conveyance enabled time elapses to make the intermittent roller 32*a* into the conveyance disabled state. Here, it is assumed that there comes the conveyance disabled state as illustrated in FIG. 10 and FIG. 11 after the card C is conveyed by a little distance by the rotation of the intermittent roller set 32.

Figure 10:
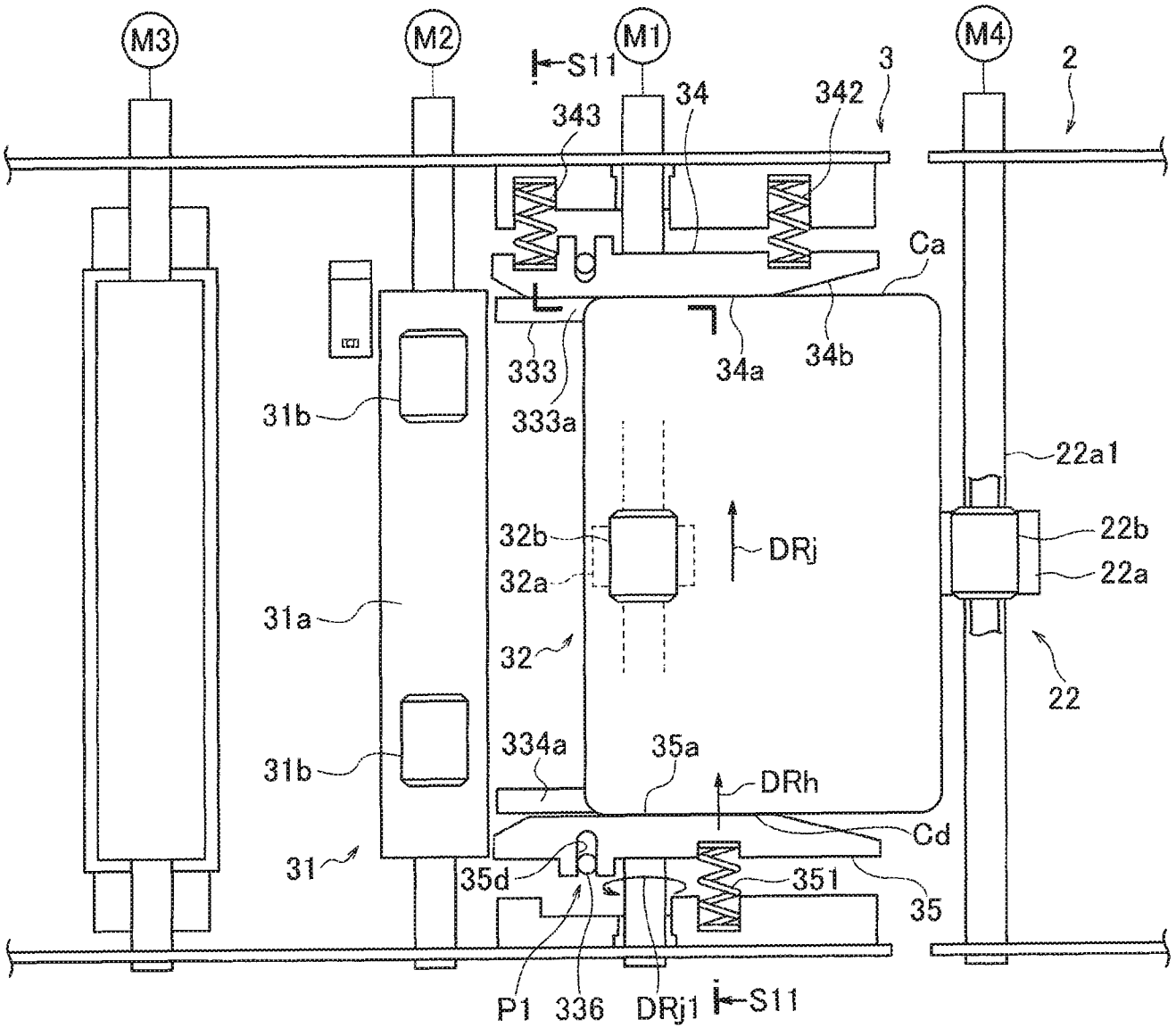
FIG. 10 is a plan view illustrating a fourth conveying state of a card C.
Figure 11:
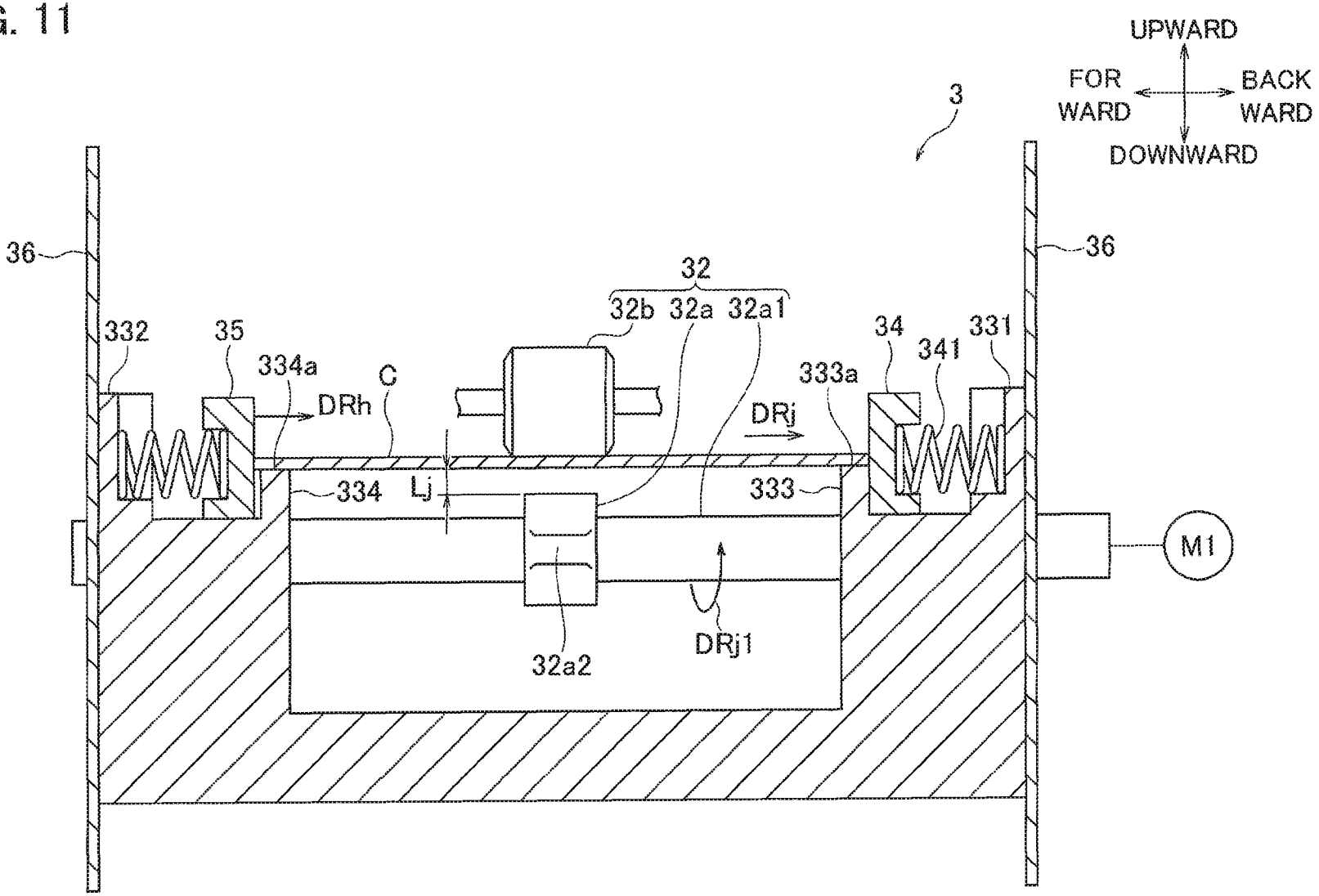
FIG. 11 is a cross-sectional view at a position S11-S11 of FIG. 10.

FIG. 11 is a cross-sectional view at a position S11-S11 in FIG. 10, illustrating a positional relationship in the upward and downward directions of the card C and the intermittent roller 32*a* in the conveyance disabled state.

As illustrated in FIG. 11, the intermittent roller 32*a* is located at a rotational position at which the protrusions 32*a*2 and 32*a*3 do not contact the card C. Moreover, though the driven roller 32*b* of the intermittent roller set 32 is in contact with the card C, the driven roller 32*b* does not substantially urge the card C downward, and a frictional force generated between the driven roller 32*b* and the card C can be ignored.

That is, when there comes the conveyance disabled state, then, as illustrated in FIG. 10 and FIG. 11, the card C is not pinched by either the second inversion roller set 22 or the intermittent roller set 32, and comes into a substantially free state of only being put by a self weight thereof on the first sliding surface 333*a* of the first support wall 333, and the second sliding surface 334*a* of the second support wall 334.

Thus, the card C easily moves backward like an arrow DRj by the urging force indicated by an arrow DRh and coming from the urging guide wall 35 against which a front edge portion Cd that is a second end portion of the card C in the width direction abuts, and an end surface of the back edge portion Ca abuts along the reference surface 34*a* of the reference guide wall 34 in a surface contact manner.

By this abutment, the back edge portion Ca is positioned at the reference front/back position PR in the forward and backward directions in a surface contact manner, and is set in an attitude parallel to the conveyance direction, and the card C becomes the card C (Ck) of which attitude is already corrected.

The urging force (first urging force) by the coil spring 351, by which the urging guide wall 35 urges the card C backward, is smaller than the urging force (second urging force) by the resultant force of the coil springs 341 and 342, which is to thrust the reference guide wall 34 against the first support wall 333. Thus, the urging guide wall 35 urges the card C to the reference guide wall 34 by the first urging force, whereby the card C is satisfactorily positioned by the reference guide wall 34 thrust against the first support wall 333 by the second urging force larger than the first urging force.

A positioning operation of the card C, that is, the attitude correction operation thereof is immediately executed when the intermittent roller set 32 and the card C come into the conveyance disabled state. Moreover, the attitude correction operation is ended in a short time, and is not executed beyond the conveyance disabled time.

When the intermittent roller 32*a* further rotates after the attitude correction operation, either of the protrusions 32*a*2 and 32*a*3 contacts the printing surface Cb of the card C (Ck), and the leftward conveyance of the card C is resumed.

Figure 12:
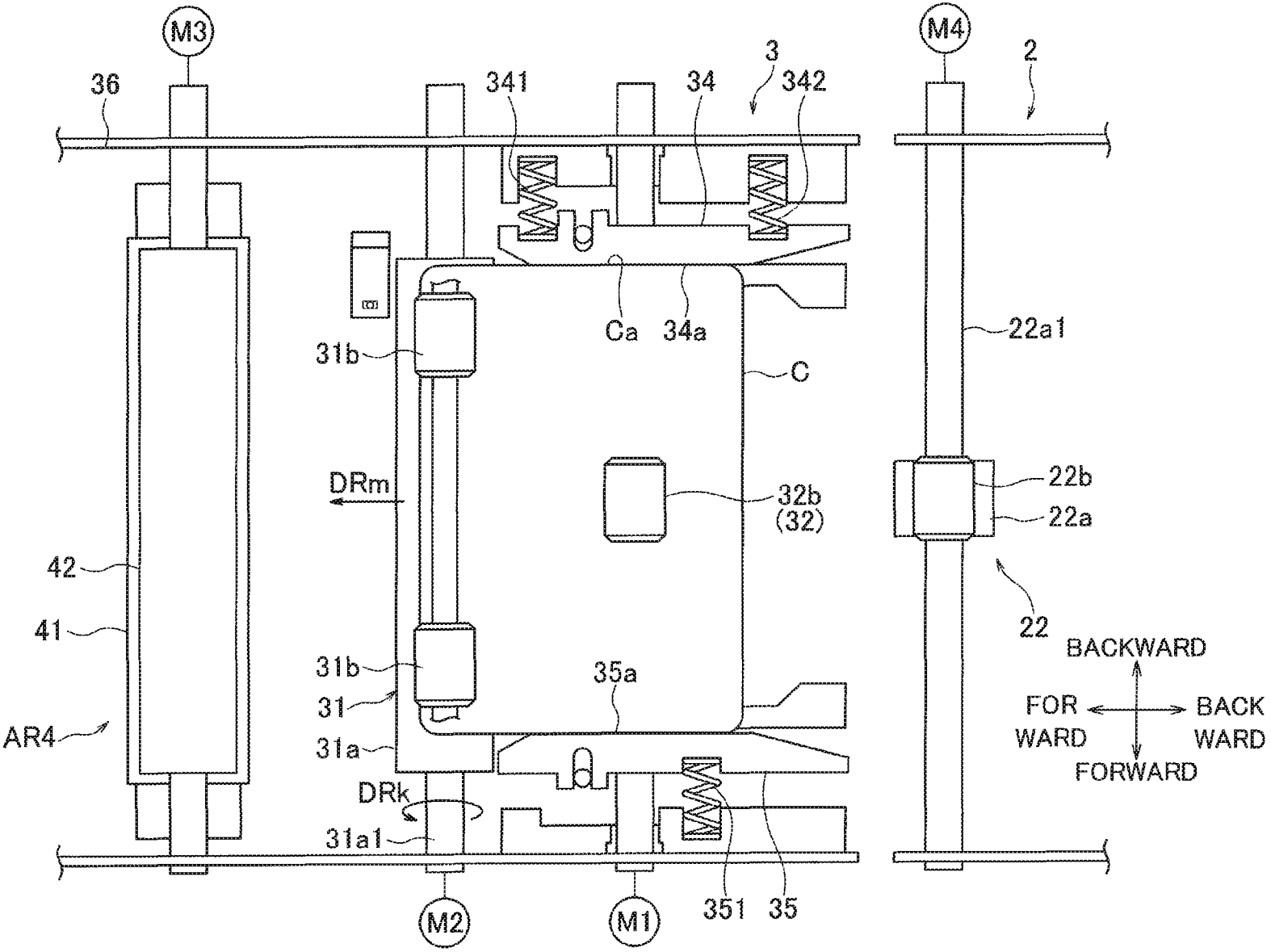
FIG. 12 is a plan view illustrating a fifth conveying state of the card C.

When the card C (Ck) is conveyed leftward, the card C (Ck) reaches a position at which the card C (Ck) is pinched by the holding roller set 31, and as illustrated in FIG. 12, the leftward conveyance is continued by the holding roller set 31 (see an arrow DRm), and the card C (Ck) is inserted into the retransfer unit AR4.

The holding roller set 31 conveys the card C (Ck) by pinching substantial both end portions thereof in the width direction by using the pair of driven rollers 31*b* separate from each other in the axial direction. Therefore, even when an unexpected external force is applied to the card C (Ck), the card C (Ck) is maintained with the unchanged attitude and position in the forward and backward directions, and is inserted into the retransfer unit AR4.

With regard to the card C (Ck) inserted into the retransfer unit AR4, in the attitude correction unit AR3, the back edge portion Ca is set parallel to the conveyance direction, and is positioned with high accuracy in the directions (upward and downward directions) perpendicular to the conveyance direction. Accordingly, the transfer image of the transfer film 82 is reliably transferred and printed to a predetermined position of the printing surface Cb of the card C with high positional accuracy.

A positioning operation is performed similarly also in a case of a second operation mode in which the card C is sent out from the inverter 2 to the attitude correction device 3 in a state in which the back edge portion Ca of the card C shifts to the front side from the reference front/back position PR on the contrary to the first operation mode described above.

Figure 13:
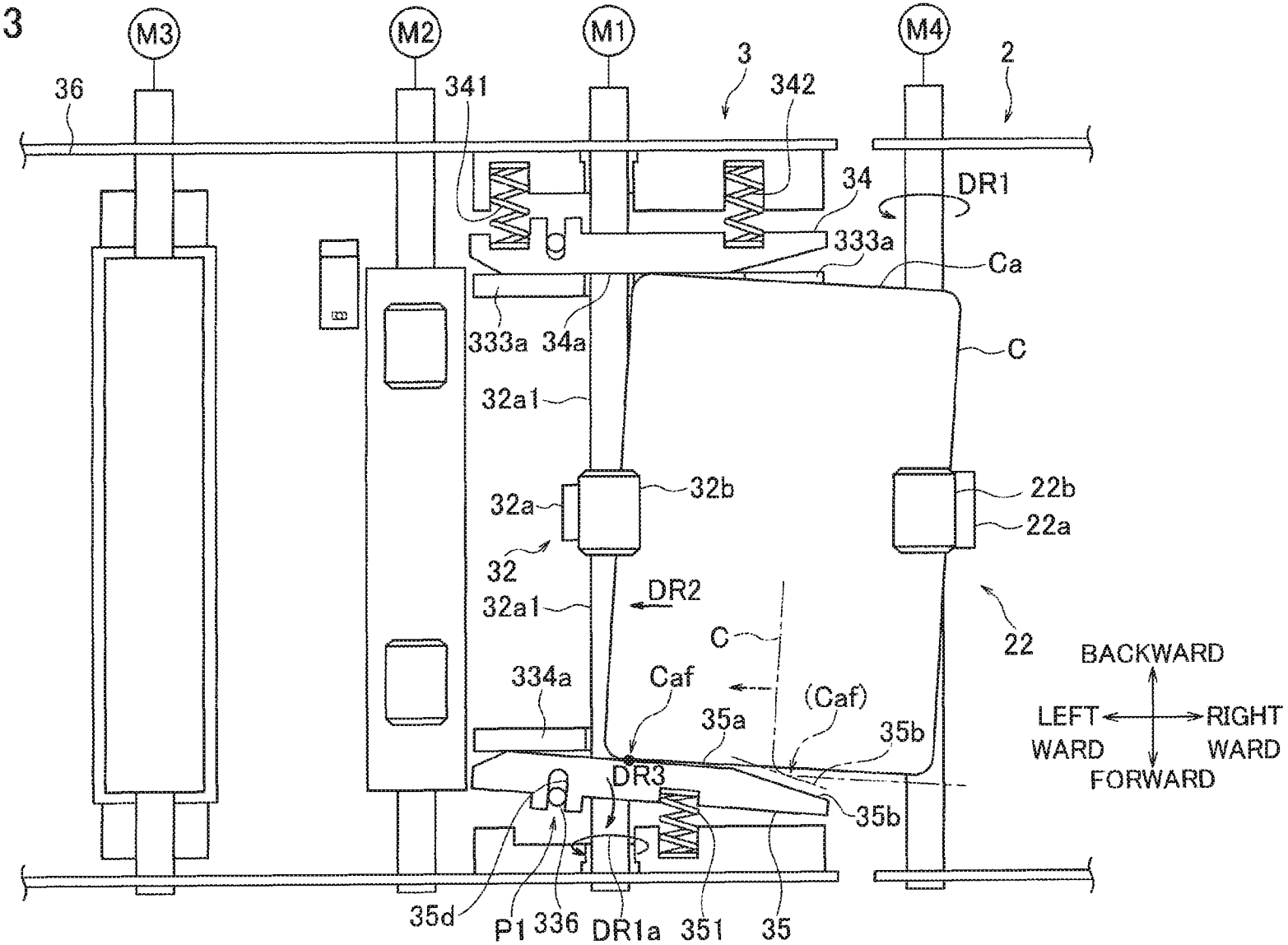
FIG. 13 is a plan view illustrating a sixth conveying state of the card C.

FIG. 13 illustrates a state in which the driving source to convey the card C changes over from the second inversion roller set 22 to the intermittent roller set 32 in the second operation mode, and the illustrated state substantially corresponds to the state of FIG. 9 in the first operation mode.

As illustrated in FIG. 13, the card C is inserted from the inverter 2 into the attitude correction device 3 at a position (illustrated by a single dashed line) shifted forward from the normal position. Therefore, the card C has the left front corner portion Caf abut against the forward feeding guide surface 35*b* of the urging guide wall 35. Thereafter, as the card C is conveyed, the urging guide wall 35 is rotated about the position P1 clockwise in FIG. 13 against the urging force of the coil spring 351. Moreover, since the second inversion roller set 22 pinches only the center portion of the card C in the forward and backward directions, the card C itself is also conveyed while rotating clockwise of FIG. 13 (see an arrow DR2).

Since the urging force as the resultant force of the coil springs 341 and 342 is large as already mentioned, the reference guide wall 34 is maintained in a state of abutting against the first support wall 333, though is pressed backward by the card C.

After the driving source to convey the card C is changed over from the second inversion roller set 22 to the intermittent roller set 32, the card C is immediately subjected to the attitude correction in the conveyance disabled state as in the first operation mode already mentioned. As described above, also, in the second operation mode, the attitude correction operation of the card C is executed stably and reliably.

Also, in a third operation mode in which the card C to which the transfer image is transferred in the retransfer unit AR4 is returned and conveyed to the inversion unit AR2, the attitude correction unit AR3 corrects the insertion attitude and insertion position of the card C into the inverter 2 to be a predetermined attitude and position. Hereinafter, the conveyance of the card C from the retransfer unit AR4 to the inversion unit AR2 will be referred to as reverse sending for the sake of convenience.

FIG. 14 to FIG. 17 are operation diagrams explaining operations in the reverse sending of the card C in the attitude correction unit AR3. Here, a description is given of a case in which the card C is sent out from the retransfer unit AR4 to the attitude correction unit AR3 in an attitude shifting backward due to an unexpected reason.

Figure 14:
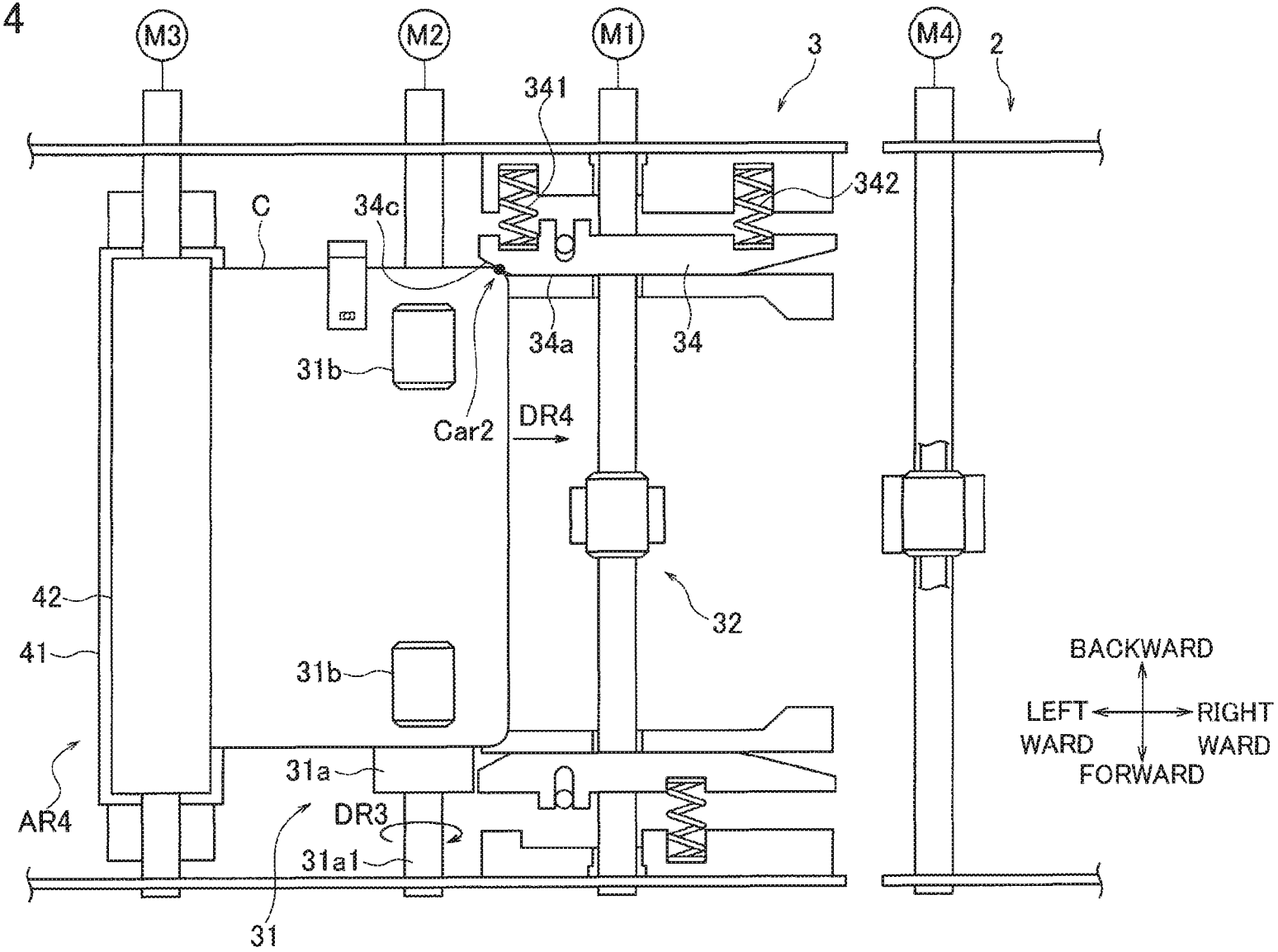
FIG. 14 is a plan view illustrating a seventh conveying state of the card C.

As illustrated in FIG. 14, the card C is conveyed rightward of FIG. 14 by the holding roller set 31, and a right back corner portion Car2 thereof abuts against a reverse feeding guide surface 34C of the reference guide wall 34.

As already mentioned, the holding roller set 31 inches both end portions of the card C in the forward and backward directions, and conveys the card C rightward of FIG. 14 (see an arrow DR4). Hence, a conveying attitude of the card C does not change due to the turning or the like, and the card C keeps on maintaining the attitude thereof against the urging force of the coil springs 341 and 342 and is conveyed.

Figure 15:
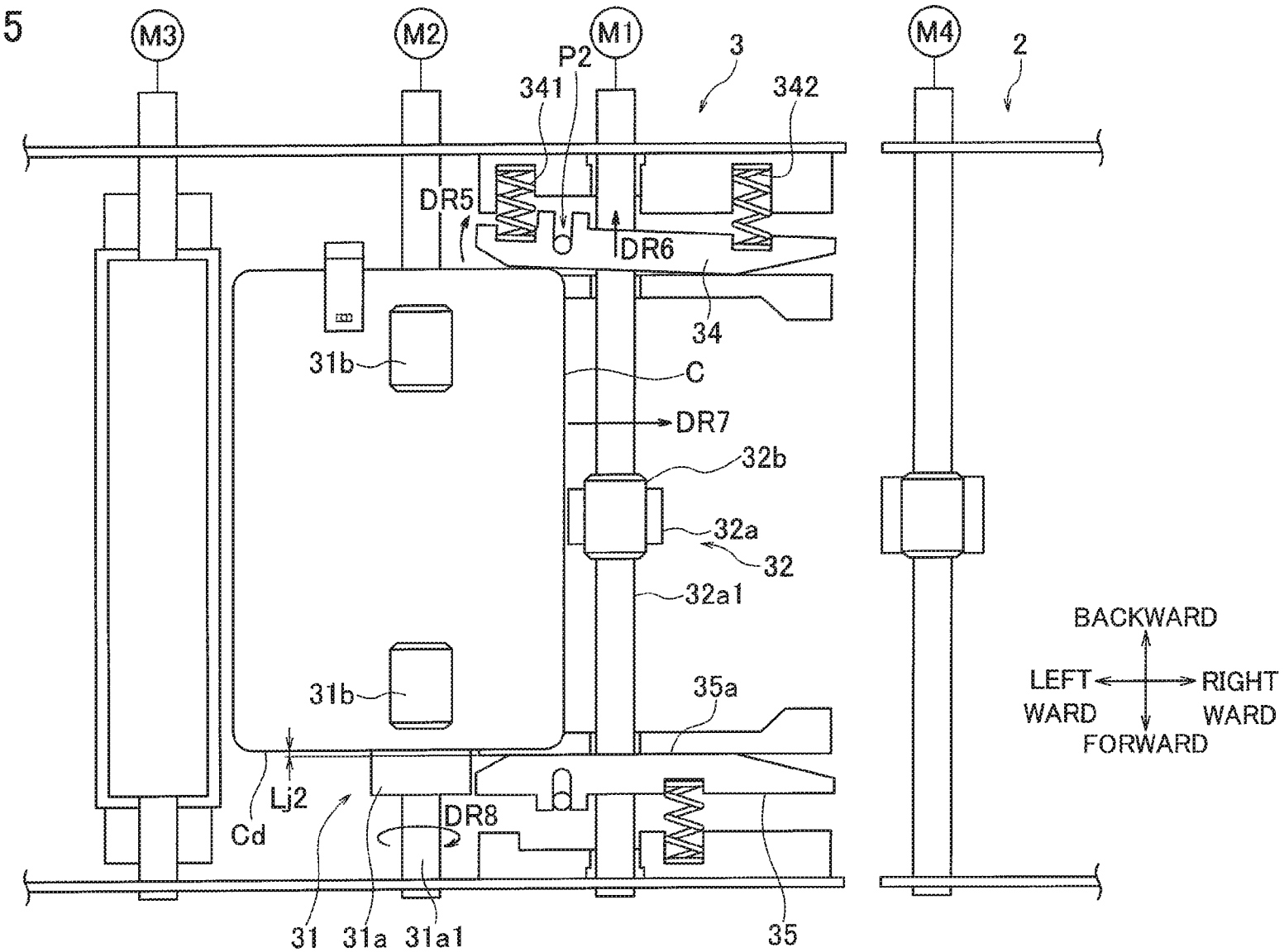
FIG. 15 is a plan view illustrating an eighth conveying state of the card C.

That is, as illustrated an FIG. 15, the left side of the reference guide wall 34 rotates about a rotation center P2 clockwise in FIG. 15 (arrow DR5), and in addition, the whole of the reference guide wall 34 also moves so as to be retreated backward (arrow DR6). The rightward movement of the card C is continued while maintaining the attitude thereof (see an arrow DR7).

In this state, since the card C keeps on shifting backward, a gap with a distance Lj2 is generated between the front edge portion Cd of the card C and the reference surface 35*a* of the urging guide wall 35.

Figure 16:
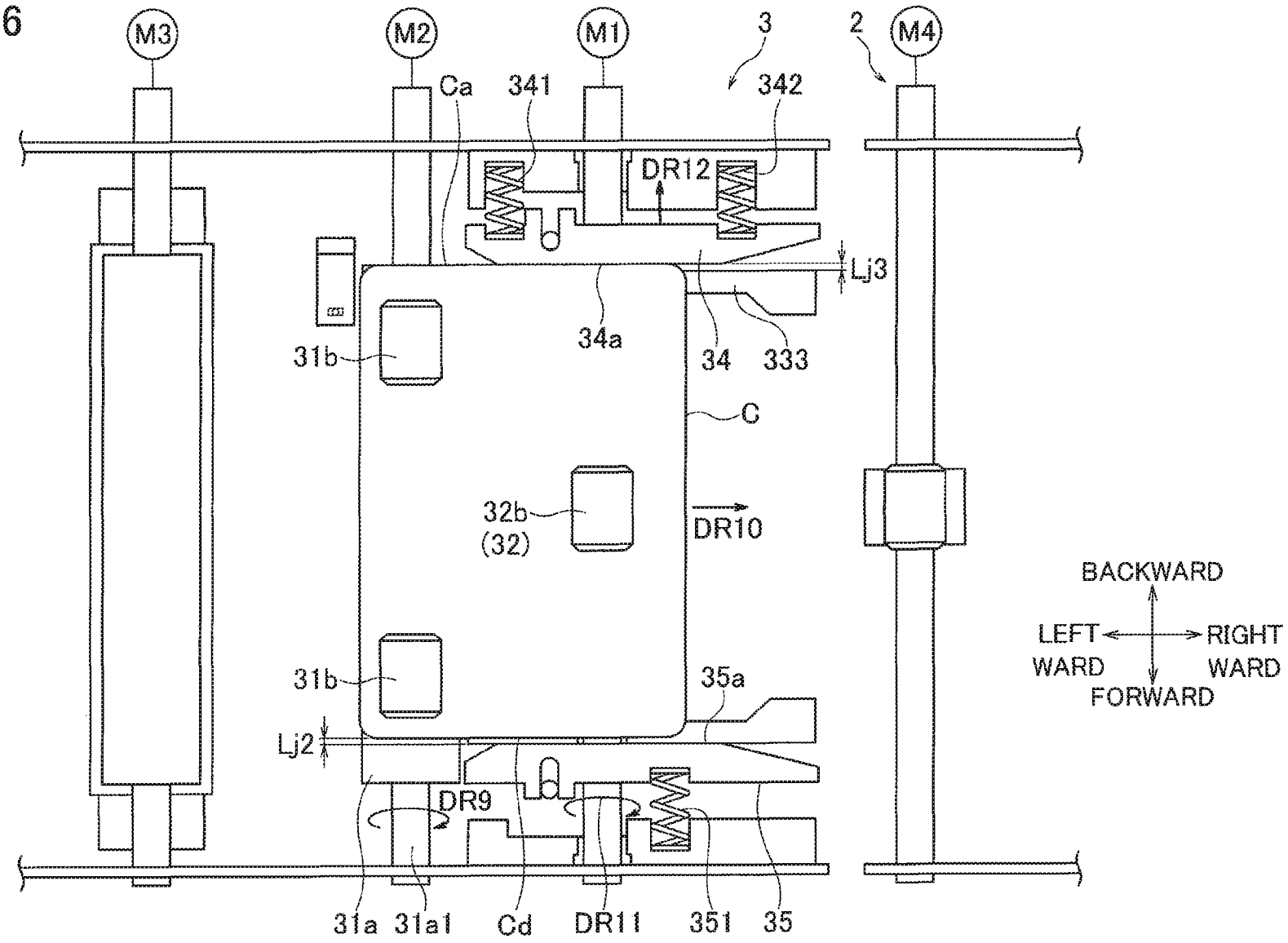
FIG. 16 is a plan view illustrating a ninth conveying state of the card C.

As illustrated in FIG. 16, the card C further continues to move rightward. The reference guide wall 34 is pushed by the card C to move backward, and a gap with a distance Lj3 in the forward and backward directions is generated between the reference guide wall 34 and the first support wall 333. Moreover, the gap with the distance Lj2 between the front edge portion Cd of the card C and the reference surface 35*a* of the urging guide wall 35 is also maintained.

When the card C further moves rightward, the card C is made free from the conveyance of being pinched by the holding roller set 31, and changes over to the conveyance by the intermittent roller set 32.

Figure 17:
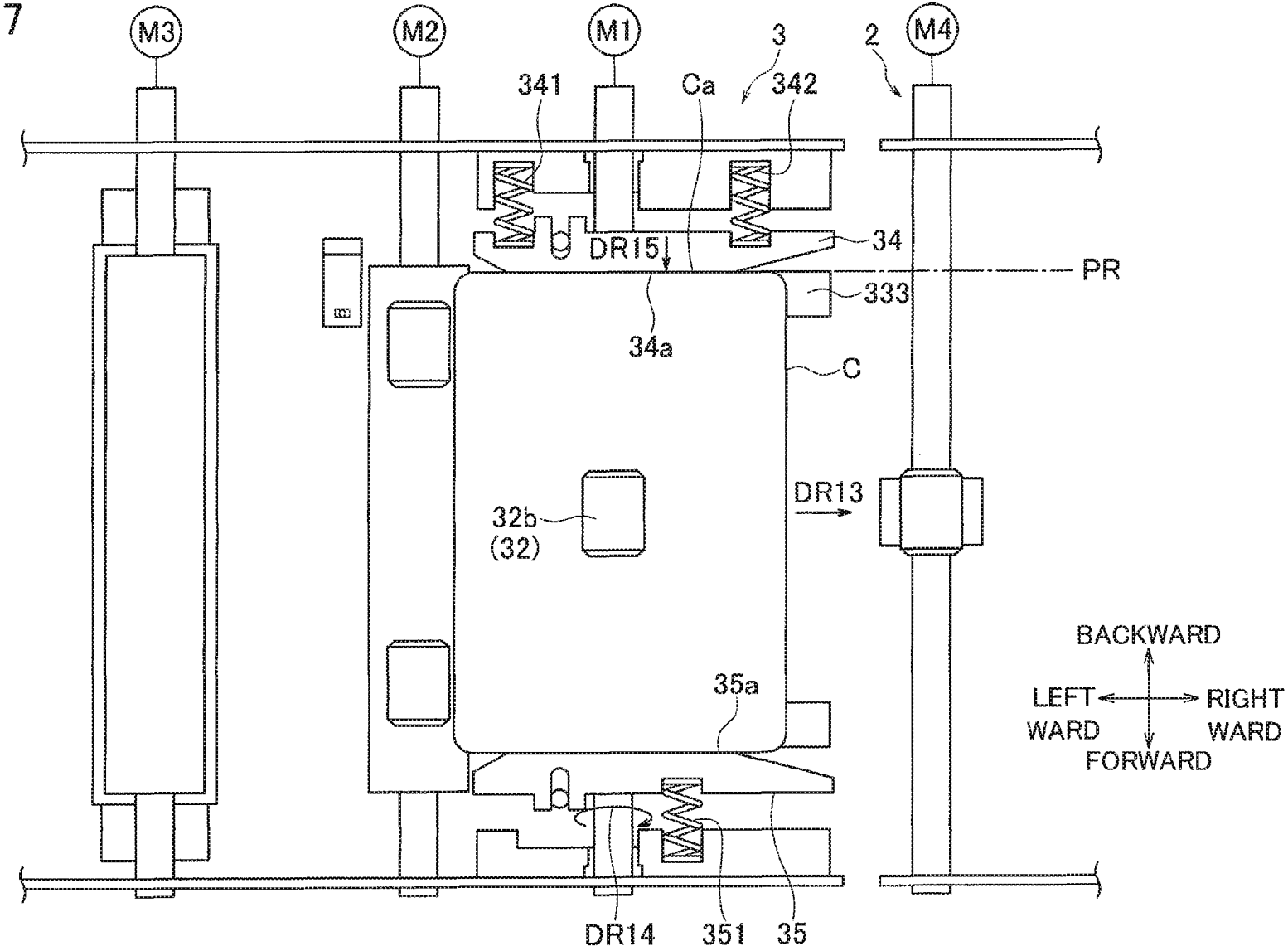
FIG. 17 is a plan view illustrating a tenth conveying state of the card C.

As already mentioned, in the conveyance of the card C by the intermittent roller set 32, there occurs without fail the conveyance disabled time while the card C becomes substantially in a free state depending on the rotation position of the intermittent roller 32*a*. As illustrated in FIG. 17, also in the third operation mode, the attitude correction operation is executed in the conveyance disabled time.

That is, the conveyance enabled time elapses, and the conveyance disabled time comes to allow the card C to be made free from the conveyance, whereby the reference guide wall 34 urged forward by the springs 341 and 342 pushes the card C forward to allow the card C to abut against the first support wall 333. Thus, like an arrow DR15, the card C is pushed to the reference surface 34*a* of the reference guide wall 34 and moves forward.

The front edge portion Cd of the card C that has moved forward is urged upward from the urging guide wall 35, and with regard to the card C, the back edge portion Ca abuts against the reference surface 34*a* of the reference guide wall 34 in a surface contact manner, and is located at the reference front/back position PR.

After this attitude correction operation, either the protrusion 32*a*2 or 32*a*3 of the rotating intermittent roller 32*a* contacts the lower surface of the card C, and the rightward conveyance of the card C is resumed (see an arrow DR13).

As described above, the attitude correction device 3 performs the attitude correction, which is the positioning of the card C in the forward/backward directions, not only at the time of the forward feeding of the card C but also at the time of the reverse feeding thereof, and inserts the card C into the inverter 2. Thus, in the printing apparatus 91, the printing position and printing attitude of the transfer image printed on the card C is determined with high accuracy, and in addition, the conveyance of the card C is satisfactorily executed as a whole, and a malfunction of the conveyance is less liable to occur.

As mentioned above, with regard to the positioning of the card C in the directions perpendicular to the conveyance direction thereof, the attitude correction device 3 and the printing apparatus 91 including the same are configured to generate, as the conveyance disabled time, a predetermined time while there occurs the conveyance disabled state in which the card C becomes substantially in a free state by using the intermittent roller for the roller set that conveys the card C. Then, the attitude correction device 3 and the printing apparatus 91 including the same are configured to perform the attitude correction by moving the card C in the directions perpendicular to the conveyance direction by using the urging guide wall and bringing the card C into surface contact with the reference guide wall during the conveyance disabled time.

That is, the attitude correction device 3 and the printing apparatus 91 including the same are configured to perform the attitude correction by generating a state in which a frictional force is not substantially applied to the card C from the outside for a predetermined time, and moving the card C perpendicularly to the conveyance direction thereof under such a state. Thus, the attitude correction device 3 and the card printing apparatus 91 including the same can perform the attitude correction of the card stably and favorably regardless of a material, thickness surface roughness, state of surface treatment and the like of the card.

As mentioned above, the attitude correction operation of the card C in the attitude correction device 3 does not require such a mechanical adjustment as a change of an adjustment position and a change of the urging force, which are performed in response to a type of the card. Hence, the storage unit 922 of the controller 92 stores only a basic operation program. Thus, the card printing apparatus 91 can form the controller 92 without using a large-capacity storage element or a high-performance CPU, and accordingly, an increase of cost is suppressed.

The present invention is not limited to the above-mentioned configuration and procedure, and is modifiable within the scope without departing from the spirit of the present invention.

In Inequality (1), as the distance Lh is shorter, the rotation angle of the intermittent roller set 32 for allowing the card C to escape from the conveyance disabled state is increased, and a time required to convey the card C is increased. For example, a case in which the intermittent roller 32*a* is required to rotate twice or more in order to allow the card C to escape from the conveyance disabled state can also happen. Accordingly, the distance Lh is defined as in Inequality (3).

$$\text{distance } Lh < (\text{distance } Lf - \text{length } Lc) < \text{distance } Lh \times 2 \quad (3)$$

Thus, during one rotation of the intermittent roller 32*a*, the conveyance disabled time is generated, without fail, to execute the attitude correction operation, and meanwhile, a driving source for the conveyance can be reliably taken over to the holding roller set 31 or the second inversion roller set 22 to allow the card C to escape from the conveyance disabled state, and conveyance efficiency of the card C is improved.

The first inversion roller set 21 and the second inversion roller set in the example are not limited to those driven by the different motors M6 and M4, respectively, and may be driven by a single motor. Moreover, a drive system may be configured so that any of the motors M1 to M4 and M6 is shared by others or that a single motor can drive the roller sets.

Moreover, the printing apparatus 91 may be an apparatus that performs only one-sided printing for the card C. In this case, the motor M5 is unnecessary.

The above-mentioned attitude correction device 3 is not limited to application to the card printing apparatus, and is applicable to an apparatus such as a card reader writer having another card conveying mechanism.

The example in which the attitude correction device 3 conveys the card C in the lateral direction is described; however, the attitude correction device 3 may convey the card C in the longitudinal direction.

The driven rollers 31*b* of the holding roller set 31 are not limited to those separated from each other in the width direction, and may extend integrally in the width direction.

As described above, in accordance with the card conveying device according to one or more embodiments, the attitude correction of the card can be performed satisfactorily regardless of the type of the card. Moreover, in accordance with the card printing apparatus according to one or more embodiments, the printing on the card can be performed satisfactorily regardless of the type of the card.

What is claimed is:

1. A card attitude correction device comprising:

a first roller set configured to convey a card in a turnable manner while pinching a central region of the card in a width direction perpendicular to a conveyance direction;

a second roller set disposed separately from the first roller set in one direction of the conveyance direction, and including an intermittent roller configured to generate, during one rotation, a conveyance enabled time of contacting the card and conveying the card and a conveyance disabled time of not contacting the card and not conveying the card;

a third roller set disposed separately from the second roller set in the one direction, and configured to convey the card in an unturnable manner;

a reference guide wall movable in a direction perpendicular to the conveyance direction, and configured to receive abutment of a first end portion of the card in the width direction and to arrange a position of the card in the width direction at a reference position;

an urging guide wall configured to urge a second end portion of the card, the second end portion being opposite to the first end portion, toward the reference guide wall by a first urging force; and a support wall configured to regulate a movement of the reference guide wall toward the urging guide wall at a position serving as the reference position, wherein the reference guide wall is urged by a second urging force larger than the first urging force toward the urging guide wall and made movable in a direction perpendicular to the conveyance direction and separating from the urging guide wall by a force to resist the second urging force, wherein, during the conveyance disabled time when the card is located at a position at which it is possible to convey the card by the second roller set, the first roller set and the third roller set are incapable of conveying the card, and the urging guide wall corrects an attitude of the card and a position of the card in the width direction by urging the card by the first urging force to allow the card to abut against the reference guide wall positionally regulated by the support wall, and wherein, when the card is conveyed toward the reference guide wall at a position at which the first end portion shifts to an opposite side to the urging guide wall with respect to the reference position, the reference guide wall maintains the position serving as the reference position regulated by the support wall and conveys the card while turning the card in a case in which the card is conveyed by the first roller set, and the reference guide wall is retreated in a direction separating from the urging guide wall and conveys the card without turning the card in a case in which the card is conveyed by the third roller set.

2. A card printing apparatus comprising:

the card attitude correction device according to claim 1; and a printing unit configured to print a card of which attitude is corrected by the card attitude correction device, wherein the printing unit positions an image in the width direction, the image to be printed on the card, based on a position in the width direction, at which the card abuts against the reference guide wall.

* * * * *